US008797371B2

(12) United States Patent
Toyotaka

(10) Patent No.: US 8,797,371 B2
(45) Date of Patent: Aug. 5, 2014

(54) METHOD FOR DRIVING FIELD SEQUENTIAL LIQUID CRYSTAL DISPLAY DEVICE

(75) Inventor: Kouhei Toyotaka, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 274 days.

(21) Appl. No.: 13/329,420

(22) Filed: Dec. 19, 2011

(65) Prior Publication Data

US 2012/0162286 A1 Jun. 28, 2012

(30) Foreign Application Priority Data

Dec. 22, 2010 (JP) ..... 2010-285253

(51) Int. Cl.
*G09G 5/10* (2006.01)

(52) U.S. Cl.
USPC ..... 345/690; 345/6; 345/88; 345/89; 345/102; 349/15

(58) Field of Classification Search
CPC ..... G09G 3/003; G09G 2310/0235; G09G 3/3413; H04N 13/0437; H04N 13/0497
USPC ..... 345/6, 88, 89, 102, 690; 349/15
See application file for complete search history.

(56) References Cited

U.S. PATENT DOCUMENTS 6,046,787 A 4/2000 Nishiguchi
6,239,453 B1 5/2001 Yamada et al.
6,314,248 B1 11/2001 Ohmura et al.
6,448,951 B1 9/2002 Sakaguchi et al.
6,580,405 B1 6/2003 Yamazaki et al.
6,597,348 B1 7/2003 Yamazaki et al.
6,730,966 B2 5/2004 Koyama
6,982,462 B2 1/2006 Koyama
7,045,369 B2 5/2006 Yamazaki et al.
7,317,438 B2 1/2008 Yamazaki et al.
7,345,661 B2 3/2008 Miyagawa et al.
7,385,579 B2 6/2008 Satake (Continued)

FOREIGN PATENT DOCUMENTS

JP 2003-066920 A 3/2003
JP 2003-259395 A 9/2003

(Continued)

OTHER PUBLICATIONS

Takeshi Nishi et al.; "Field-Sequential Blue-Phase Mode 2D/3D Display Applying Crystalline Oxide Semiconductor"; AM-FPD '11 Digest of Technical Papers; 2011; pp. 113-116.

*Primary Examiner* — Gregory J Tryder
*Assistant Examiner* — Peter D McLoone
(74) *Attorney, Agent, or Firm* — Fish & Richardson P.C.

(57) ABSTRACT

To reduce crosstalk in sequential frame periods. An image signal is written to a pixel in a first sub-frame period. Then, just before a second sub-frame period, the light source is lit in accordance with the image signal written in the first sub-frame period and sequentially, the image signal is written in the second sub-frame period of the right eye frame period. Then, just before the next first sub-frame period, the light source is lit in accordance with the image signal in the third sub-frame period and sequentially, writing of the image signal is performed in the third sub-frame period of the right eye frame period.

20 Claims, 18 Drawing Sheets

(56) References Cited

U.S. PATENT DOCUMENTS

| | | | | |
|---|---|---|---|---|
| 7,385,625 | B2 | 6/2008 | Ohmura et al. | |
| 7,403,177 | B2 | 7/2008 | Tanada et al. | |
| 7,525,119 | B2 | 4/2009 | Koyama | |
| 7,727,779 | B2 | 6/2010 | Yamazaki et al. | |
| 7,834,830 | B2 | 11/2010 | Yamazaki et al. | |
| 2001/0000335 | A1 | 4/2001 | Yamada et al. | |
| 2002/0001472 | A1 | 1/2002 | Ohmura et al. | |
| 2008/0258997 | A1* | 10/2008 | Arai | 345/6 |
| 2008/0259099 | A1* | 10/2008 | Arai et al. | 345/690 |
| 2009/0218573 | A1 | 9/2009 | Koyama | |
| 2009/0237495 | A1* | 9/2009 | Kawahara | 348/56 |
| 2009/0303219 | A1 | 12/2009 | Kimura et al. | |
| 2010/0066820 | A1* | 3/2010 | Park et al. | 348/53 |
| 2010/0289969 | A1 | 11/2010 | Yamazaki et al. | |
| 2010/0302468 | A1* | 12/2010 | Lin | 349/15 |
| 2011/0025729 | A1 | 2/2011 | Yamazaki et al. | |
| 2011/0242100 | A1* | 10/2011 | Yamazaki et al. | 345/419 |
| 2012/0127384 | A1* | 5/2012 | Miyake et al. | 349/15 |
| 2012/0133648 | A1* | 5/2012 | Hirakata | 345/419 |

FOREIGN PATENT DOCUMENTS

| | | | |
|---|---|---|---|
| JP | 2006-220685 | A | 8/2006 |
| JP | 2007-264211 | A | 10/2007 |
| JP | 2009-031523 | A | 2/2009 |
| JP | 2009-230071 | A | 10/2009 |

* cited by examiner

METHOD FOR DRIVING FIELD SEQUENTIAL LIQUID CRYSTAL DISPLAY DEVICE

BACKGROUND OF THE INVENTION

1. Field of the Invention

The present invention relates to a method for driving a liquid crystal display device.

2. Description of the Related Art

Liquid crystal display devices ranging from a large display device such as a television receiver to a small display device such as a mobile phone have been spreading. From now on, products with higher added values will be needed and are being developed. In recent years, in view of rising interest in the global environment and improvement in convenience of mobile devices, development of low-power-consumption display devices has attracted attention.

As a low-power-consumption display device, there is a display device for displaying images by a field-sequential method (also referred to as a color-sequential display method, a time-division display method, or a successive additive color mixture display method). In the field sequential system, lighting of backlights of red (hereinafter also abbreviated to R in some cases), green (hereinafter also abbreviated to G in some cases), and blue (hereinafter also abbreviated to B in some cases) are switched with time, lights of R, G, and B are supplied to a display panel, and color images are seen by an additive color mixture. Thus, it is not necessary to provide a color filter in each pixel, the use efficiency of transmitting light from a backlight can be improved, and power consumption can be reduced. Since R, G, and B can be expressed in one pixel in a field-sequential display device, the field-sequential display device has an advantage that high-resolution images can be easily displayed.

Drive for the field-sequential system has a unique problem of display defect such as color breakup (also referred to as color break). It is known that the increase in frequency of write of video signals in a given period can reduce the problem of color breakup.

Patent Document 1 discloses a structure in which, in order to increase the number of writing cycles of image signals in a certain period in a field sequential liquid crystal display device, a display region is divided into a plurality of regions, and a corresponding backlight unit is also divided into a plurality of regions.

In addition, Patent Document 2 discloses a structure configured to display a stereoscopic image (three-dimensional image) in a field sequential liquid crystal display device.

REFERENCE

[Patent Document 1] Japanese Published Patent Application No. 2006-220685

[Patent Document 2] Japanese Published Patent Application No. 2003-259395

SUMMARY OF THE INVENTION

In the structure of Patent Document 1, a display region is divided into a plurality of regions to which image signals of different colors are supplied, and driving by a field sequential system is performed. In addition, a backlight unit corresponding to the plurality of regions of the display region is also divided into a plurality of regions, and the light emission of the backlight unit is performed using different colors in adjacent regions. Note that driving of a backlight unit when a display region is divided into a plurality of regions to which image signals of different colors are supplied and a light source of the backlight unit corresponding to the plurality of regions of the display region is also divided into a plurality of regions to perform driving by a field sequential system is referred to as color scan backlight driving (or scan backlight driving).

By the color scan backlight driving, while red (R) image signals are sequentially written in a plurality of regions, green (G) image signals and blue (B) image signals are written from the regions to which the R image signals have been written.

Here, in order to describe an object of an embodiment of the present invention, the color scan backlight driving will be described with reference to FIGS. 18A and 18B.

FIG. 18A is a schematic view of writing of an image signal and lighting of a light source. Note that a region A1 illustrated in FIG. 18A to which an image signal is written is a region in which a plurality of pixels are arranged in a row direction and a column direction and to which an image signal is written through a scan line and a signal line. In FIG. 18A, an oblique side 1601 represents writing of image signals through scan lines is performed sequentially in a scanning direction, and "R1" illustrated within a parallelogram framework means that the image signals are red image signals. FIG. 18A shows that response of a liquid crystal element and lighting of the light source are conducted in accordance with writing of the image signal through a scan line sequentially performed in a scan direction.

FIG. 18B illustrates color scan backlight driving in consecutive frame periods, using the writing period of the image signals and the lighting period of the light sources described in FIG. 18A. Note that R1 to R6, G1 to G6, and B1 to B6 in FIG. 18B show image signals corresponding to color components which are written to a first region A1, a second region A2, and a third region A3 provided in a scan direction, and means that liquid crystal elements are responded in accordance with the image signals, and the light source is turned on. For example, in a first left eye frame period F_1L, in the first region A1, color display is perceived by an additive color mixture of R1, G1, and B1; in the second region A2, color display is perceived by an additive color mixture of R2, G2, and B2; and in the third region A3, color display is perceived by an additive color mixture of R3, G3, and B3. Thus, in the first left eye frame period F_1L, one image is displayed by color display in the first region A1 to the third region A3. Note that also in a first right eye frame period F_1R, one image is displayed by color display in the first region A1 to the third region A3.

A period Tov in which the first left eye frame period F_1L and the first right eye frame period F_1R overlap with each other in displaying one image by an additive color mixture in the first region A1 to the third region A3 illustrated in FIG. 18B is provided. Since the period Tov in which the first left eye frame period F_1L and the first right eye frame period F_1R overlap with each other exists, separation of the right and left images becomes difficult when an image is seen through glasses having an optical shutter in the case where a stereoscopic image is displayed by a frame sequential method.

It is necessary for a structure in which a black image is provided between the first left eye frame period F_1L and the first right eye frame period F_1R and an image for seeing with right and left eyes is displayed to accelerate the writing speed of image signals in order to display a moving image without a blink (flicker). Therefore, sufficient time for writing image signals cannot be obtained, which causes display defects.

An object of an embodiment of the present invention is to provide a driving method of a liquid crystal display device in which display defects such as crosstalk are reduced when images perceived by left and right eyes are switched by a frame sequential method to display a stereoscopic image.

In an embodiment of the present invention, a light source is lit not to overlap with lighting of another light source in case crosstalk should occur when images perceived by left and right eyes are switched by the frame sequential method with color scan backlight driving to display a stereoscopic image. Specifically, in an embodiment of the present invention, in the case where images are switched between an image in a left eye frame period and an image in a right eye frame period, an image signal for lighting of a light source in a first sub-frame period of the right eye frame period is written to a pixel in a third sub-frame period of the left eye frame period. Then, just before the first sub-frame period of the right eye frame period, the light source is lit in accordance with the image signal written in the third sub-frame period of the left eye frame period and sequentially the image signal is written in the first sub-frame period of the right eye frame period. The images are displayed at the timing at which lighting of the light source by an image signal written in a second sub-frame period of the right eye frame period and lighting of the light source by an image signal written in the third sub-frame period of the right eye frame period are switched, and left and right images perceived by the frame sequential method are switched with the use of glasses.

An embodiment of the present invention is a method for driving a liquid crystal display device including the steps of dividing a display region into a plurality of regions, selecting one of a plurality of scan lines in each of the plurality of divided regions at the same time and displaying an image; displaying an image for a left eye displayed in a first frame period and an image for a right eye displayed in a second frame period alternately on the display region; and performing color display in the display region in each of the first frame period and the second frame period, each including a first sub-frame period, a second sub-frame period, and a third sub-frame period in which an image signal of one of a plurality of color components is written to the divided regions in a writing period, by lighting of a light source in accordance with the image signal written in the first to third sub-frame periods. An image signal written in the first sub-frame period of one of the first frame period and the second frame period is an image signal for the light source lit just before writing of an image signal of the second sub-frame period of one of the first frame period and the second frame period. An image signal written in the second sub-frame period of one of the first frame period and the second frame period is an image signal for the light source lit just before writing of an image signal of the third sub-frame period of one of the first frame period and the second frame period. An image signal written in the third sub-frame period of one of the first frame period and the second frame period is an image signal for the light source lit just before writing of an image signal of the first sub-frame period of the other of the first frame period and the second frame period.

An embodiment of the present invention is a method for driving a liquid crystal display device including the steps of dividing a display region into a plurality of regions, selecting one of scan lines in each of divided regions at the same time and displaying an image; displaying an image for a left eye displayed in a first frame period and an image for a right eye displayed in a second frame period alternately on the display region; and performing color display in the display region in the first frame period and the second frame period, each including a first sub-frame period, a second sub-frame period, and a third sub-frame period in which an image signal of one of a plurality of color components is written to the divided regions in a writing period, by lighting of a light source in accordance with the image signal written in the first to third sub-frame periods. An image signal written in the first sub-frame period of one of the first frame period and the second frame period is an image signal for the light source lit just before writing of an image signal of the second sub-frame period of one of the first frame period and the second frame period. An image signal written in the second sub-frame period of one of the first frame period and the second frame period is an image signal for the light source lit just before writing of an image signal of the third sub-frame period of one of the first frame period and the second frame period. An image signal written in the third sub-frame period of one of the first frame period and the second frame period is an image signal for the light source lit just before writing of an image signal of the first sub-frame period of the other of the first frame period and the second frame period. In glasses with which the image for a left eye and the image for a right eye are alternately perceived, switching of perception is performed at timing at which lighting of the light source in accordance with the image signal written in the third sub-frame period of one of the first frame period and the second frame period, and lighting of the light source in accordance with the image signal written in the first sub-frame period of the other of the first frame period and the second frame period are switched.

An embodiment of the present invention is a method for driving a liquid crystal display device including the steps of dividing a display region into a plurality of regions, selecting one of scan lines in each of divided regions at the same time and displaying an image; displaying an image for a left eye displayed in a first frame period and an image for a right eye displayed in a second frame period alternately on the display region; and performing color display in the display region in the first frame period and the second frame period, each including a first sub-frame period, a second sub-frame period, and a third sub-frame period in which an image signal of one of a plurality of color components is written to the divided regions in a writing period, by lighting of a light source in accordance with the image signal written in the first to third sub-frame periods. An image signal written in the first sub-frame period of one of the first frame period and the second frame period is an image signal for the light source lit just before writing of an image signal of the second sub-frame period of one of the first frame period and the second frame period. An image signal written in the second sub-frame period of one of the first frame period and the second frame period is an image signal for the light source lit just before writing of an image signal of the third sub-frame period of one of the first frame period and the second frame period. An image signal written in the third sub-frame period of one of the first frame period and the second frame period is an image signal for the light source lit just before writing of an image signal of the first sub-frame period of the other of the first frame period and the second frame period. A period in which the light source is lit in accordance with the image signal written in the first to third sub-frame periods is shorter than a period needed for writing of an image signal.

An embodiment of the present invention is a method for driving a liquid crystal display device including the steps of dividing a display region into a plurality of regions, selecting one of scan lines in each of divided regions at the same time and displaying an image; displaying an image for a left eye displayed in a first frame period and an image for a right eye displayed in a second frame period alternately on the display region; and performing color display in the display region in the first frame period and the second frame period, each including a first sub-frame period, a second sub-frame period, and a third sub-frame period in which an image signal of one of a plurality of color components is written to the divided regions in a writing period, by lighting of a light source in accordance with the image signal written in the first to third sub-frame periods. An image signal written in the first sub-frame period of one of the first frame period and the second frame period is an image signal for the light source lit just before writing of an image signal of the second sub-frame period of one of the first frame period and the second frame period. An image signal written in the second sub-frame period of one of the first frame period and the second frame period is an image signal for the light source lit just before writing of an image signal of the third sub-frame period of one of the first frame period and the second frame period. An image signal written in the third sub-frame period of one of the first frame period and the second frame period is an image signal for the light source lit just before writing of an image signal of the first sub-frame period of the other of the first frame period and the second frame period. In glasses with which the image for a left eye and the image for a right eye are alternately perceived, switching of perception is performed at timing at which lighting of the light source in accordance with the image signal written in the third sub-frame period of one of the first frame period and the second frame period, and lighting of the light source in accordance with the image signal written in the first sub-frame period of the other of the first frame period and the second frame period are switched. A period in which the light source is lit in accordance with the image signal written in the first to third sub-frame periods is shorter than a period needed for writing of an image signal.

According to an embodiment of the present invention, a driving method of a liquid crystal display device in which the liquid crystal element is a liquid crystal material exhibiting a blue phase may be used.

According to an embodiment of the present invention, a driving method of a liquid crystal display device in which the light sources are light sources of red, green and blue may be used.

According to an embodiment of the present invention, left and right images are switched at the timing at which lighting of the light source is switched when images perceived by left and right eyes are switched by a frame sequential method and a stereoscopic image is displayed. Therefore, when left and right images are switched, display defects such as crosstalk caused by lighting of the light source can be reduced.

DETAILED DESCRIPTION OF THE INVENTION

Figure 1A:
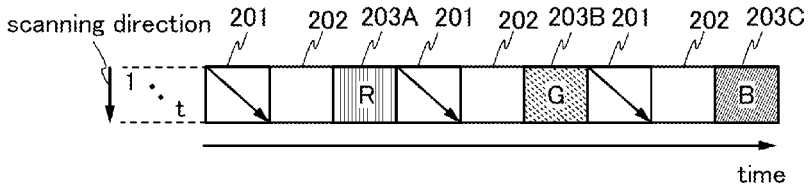
FIGS. 1A and 1B are diagrams to describe the structure of Embodiment 1.

Hereinafter, embodiments of the present invention will be described with reference to the accompanying drawings. However, the present invention can be carried out in many different modes, and it is easily understood by those skilled in the art that modes and details of the present invention can be modified in various ways without departing from the purpose and the scope of the present invention. Therefore, the present invention should not be construed as being limited to the following description of the embodiments. Note that in structures of the present invention described below, reference numerals denoting the same portions are used in common in different drawings.

Note that, the size, layer thickness, and signal waveform of each object shown in the drawings and the like in the embodiments are exaggerated for simplicity in some cases. Therefore, embodiments of the present invention are not limited to such scales.

Note that terms such as first, second, third to n-th (n is a natural number) seen in this specification are used in order to avoid confusion between components and do not set a limitation on number.

Embodiment 1

In this embodiment, a method for driving a liquid crystal display device in an embodiment of the present invention will be described.

FIG. 1A is a schematic view illustrating writing of image signals, response of liquid crystal elements in accordance with the image signals, and lighting of light sources corresponding to regions to which the image signals are written. A block 201 in FIG. 1A in which an arrow (oblique line) is drawn shows a period in which selection signals are sequentially supplied to a plurality of scan lines (also referred to as gate lines) in a direction (scanning direction) where the plurality of scan lines is provided, so that a state of writing of image signals of signal lines (also referred to as data lines) are written. A block 202 in FIG. 1A which is a blank shows a period which is needed for alignment of a liquid crystal material included in a liquid crystal element, which is aligned by an image signal supplied to pixel electrodes of pixels. Blocks 203A to 203C in FIG. 1A shown by oblique hatching each show a period in which the light source is lit for emitting light transmitted through liquid crystal elements. FIG. 1A shows the case that over time, writing of an image signal to scan lines in the first to t-th row (t is a natural number), response of a liquid crystal element in accordance with the image signal, and lighting of the light source are sequentially performed.

In this embodiment, writing of an image signal means that a selection signal, for example, a high-level potential is supplied to a scan line to turn on a transistor in a pixel which is connected to the scan line and an image signal of a signal line is supplied to a pixel electrode in the pixel.

Note that a liquid crystal element is an element in which whether light is transmitted through the element or not is controlled by alignment of a liquid crystal material, and includes a pair of electrodes and a liquid crystal material. Note that alignment of the liquid crystal material is controlled in such a manner that the molecular orientation of the liquid crystal material is rotated in a predetermined direction by an electric field (including an electric field in a horizontal direction, an electric field in a vertical direction, and an electric field in an oblique direction) applied to liquid crystal.

Note that the liquid crystal material preferably exhibits a blue phase, for which no alignment film is needed. A blue phase is one of liquid crystal phases, which is generated just before a cholesteric phase changes into an isotropic phase while temperature of cholesteric liquid crystal is increased. Since the blue phase is generated within an only narrow range of temperature, liquid crystal material containing a chiral agent so as to improve the temperature range is used. As for the liquid crystal composition which contains a liquid crystal exhibiting a blue phase and a chiral agent, the response speed is as high as 10 μs to 100 μs, alignment treatment is not necessary due to optical isotropy, and viewing angle dependence is low. In addition, since an alignment film does not need to be provided and rubbing treatment is unnecessary, electrostatic discharge damage caused by the rubbing treatment can be prevented and defects and damage of the liquid crystal display device can be reduced in the manufacturing process.

In the blocks 203A to 203C with hatching showing lighting of the light source, the light source is lit using color components for color display by an additive color mixture. In this embodiment, there are three color components of the light source corresponding to the blocks 203A to 203C: R (red: the block 203A), G (green: the block 203B), and B (blue: the block 203C). Note that in the drawing, lighting of the light sources of R, G, and B is shown by using different hatchings. A light source of other kinds of colors other than R, G, and B may be used in combination. For example, in addition to the three colors of R, G, and B, a yellow light-emitting diode, a magenta light-emitting diode, a cyan light-emitting diode, or the like may be used. In addition to the three colors of R, G and B, a white light-emitting diode can be used.

Figure 1B:
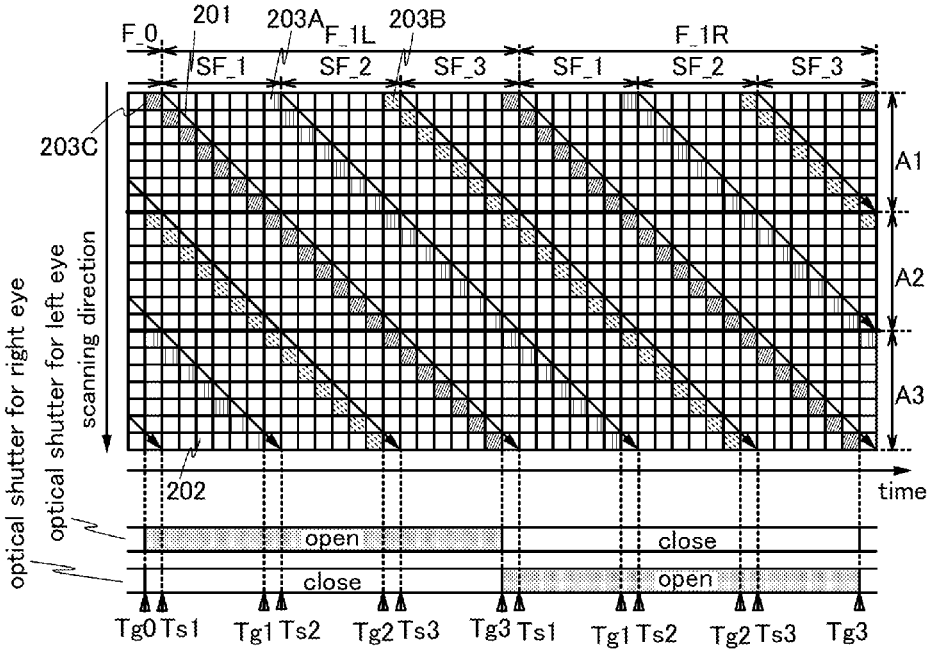

FIG. 1B illustrates a method for driving a display device of this embodiment in which display defects such as crosstalk, which occur when images perceived by left or right eye are switched by a frame sequential method to display a stereoscopic image can be reduced. By using the schematic view of FIG. 1A, FIG. 1B shows operation in sequential frames in which writing of an image signal, response of a liquid crystal element in accordance with the image signal, and lighting of the light source corresponding to a region to which the image signal is written are performed.

In FIG. 1B, an image signal is written, a liquid crystal element responds in accordance with the image signal, and the light source corresponding to a region to which the image signal is written is lit, for each of blocks provided in a scanning direction. In FIG. 1B, the plurality of blocks, which have been divided to align along a scanning direction, is roughly classified into a first region A1, a second region A2, and a third region A3. The first region A1 to the third region A3 each include a plurality of blocks in the scanning direction, and operation in the regions can be explained.

Figure 2A:
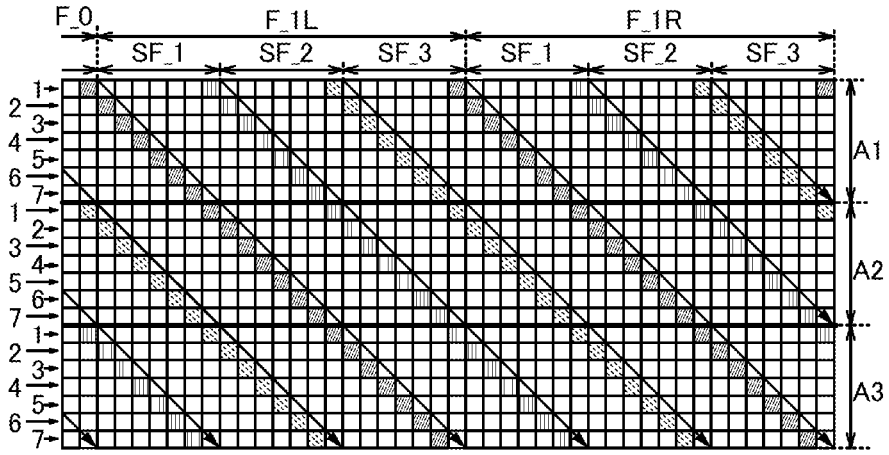
FIGS. 2A and 2B are diagrams to describe the structure of Embodiment 1.

Note that in the following description, for explanation of the plurality of blocks in the first region A1 to the third region A3, the rows in each of the first region A1 to the third region A3 are denoted by 1 to 7 as illustrated in FIG. 2A. Accordingly, the first region A1 in FIG. 1B has the plurality of blocks in the first to the seventh rows. Similarly, the second region A2 in FIG. 1B has the plurality of blocks in the first to the seventh rows. Similarly, the third region A3 in FIG. 1B has the plurality of blocks in the first to the seventh rows. Note that for example, the greater the number of blocks in the first region A1 to the third region A3 is, the shorter a writing period can be, which is preferable.

Figure 2B:
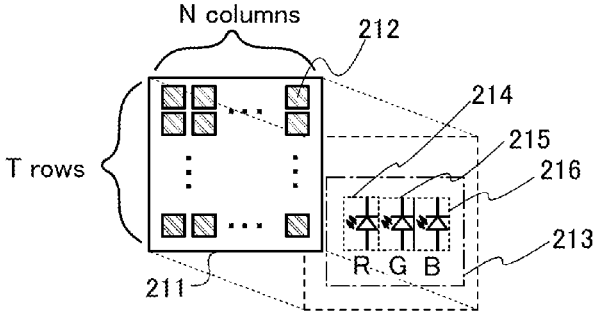

FIG. 2B illustrates the specific structure of the plurality of blocks in the first region A1 to the third region A3 in FIG. 1B. Each block overlaps with a plurality of pixels connected to scan lines and signal lines and corresponds to a set of light sources of R, G, and B. A plurality of pixels 212 included in one block 211 is, for example, in the case where pixels of a display region are provided in M rows and N columns (M is a natural number of 3 or more), pixels in T rows (T is a number of M divided by 21 (=7×3)) and N columns (N is a natural number of 3 or more) as illustrated in FIG. 2B. A set of light sources 213 of R, G, and B which overlaps with the plurality of pixels of the block 211 is, for example, a set of light sources including an R light-emitting diode (LED) 214, a G light-emitting diode 215, and a B light-emitting diode 216. The light source 213 including a light source with a plurality of color components can emit light with various colors for each block.

FIG. 1B shows the first left eye frame period F_1L and the first right eye frame period F_1R, which are a period for displaying an image perceived by a left eye and a period for displaying an image perceived by a right eye, respectively. The first left eye frame period F_1L includes a first sub-frame period SF_1, a second sub-frame period SF_2, and a third sub-frame period SF_3 as periods in which an image signal for perception by a left eye is written. Similarly, the first right eye frame period F_1R includes a first sub-frame period SF_1, a second sub-frame period SF_2, and a third sub-frame period SF_3 as periods in which an image signal for perception by a right eye is written. In this embodiment, the first left eye frame period F_1L and the first right eye frame period F_1R are focused on for explanation. Note that similar operation is repeated in a left eye frame period and a right eye frame period which are thereafter provided an alternate manner, so that stereoscopic vision can be performed by the frame sequential method.

Note that the first sub-frame periods SF_1 in the first left eye frame period F_1L and the first right eye frame period F_1R are periods in each of which an image signal of R is written to the first region A1 (in FIG. 1B, the block 201 with an arrow). Similarly, the first sub-frame periods SF_1 in the first left eye frame period F_1L and the first right eye frame period F_1R are periods in each of which an image signal of B is written to the second region A2. Similarly, the first sub-frame periods SF_1 in the first left eye frame period F_1L and the first right eye frame period F_1R are periods in each of which an image signal of G is written to the third region A3. Note that in the case of display using four colors or more where any of other colors is added to R, G, and B, operation may be performed by increasing the number of periods in addition to the first sub-frame period SF_1 to the third sub-frame period SF_3.

Further, the second sub-frame periods SF_2 in the first left eye frame period F_1L and the first right eye frame period F_1R are periods in each of which an image signal of G is written to the first region A1 (in FIG. 1B, the block 201 with an arrow). Similarly, the second sub-frame periods SF_2 in the first left eye frame period F_1L and the first right eye frame period F_1R are periods in each of which an image signal of R is written to the second region A2. Similarly, the second sub-frame periods SF_2 in the first left eye frame period F_1L and the first right eye frame period F_1R are periods in each of which an image signal of B is written to the third region A3.

Note that the third sub-frame periods SF_3 in the first left eye frame period F_1L and the first right eye frame period F_1R are periods in each of which an image signal of B is written to the first region A1 (in FIG. 1B, the block 201 with an arrow). Similarly, the third sub-frame periods SF_3 in the first left eye frame period F_1L and the first right eye frame period F_1R are periods in each of which an image signal of G is written to the second region A2. Similarly, the third sub-frame periods SF_3 in the first left eye frame period F_1L and the first right eye frame period F_1R are periods in each of which an image signal of R is written to the third region A3.

As shown in FIG. 1B, in each of the first sub-frame period SF_1, the second sub-frame period SF_2, and the third sub-frame period SF_3, the image signals are sequentially written to the blocks in the first region A1 to the third region A3 at the same time. Accordingly, a scan line driver circuit controlling the scan line in the display region selects one scan line in each of the first region A1 to the third region A3, and an image signal is supplied through the plurality of signal lines or the image signal is supplied by varying timings to supply the image signal of the plurality of signal line, so that an image signal is selectively supplied to the pixels.

FIG. 1B shows a period (in FIG. 1B, the block 202 which is a blank) which is needed for alignment of the liquid crystal material of the liquid crystal element and which is followed by writing of the image signals in the first sub-frame period SF_1, the second sub-frame period SF_2, and the third sub-frame period SF_3. The period in FIG. 1B needed for alignment of the liquid crystal materials of the liquid crystal element is subsequently provided for all blocks in the first region A1 to the third region A3, and the liquid crystal materials of the liquid crystal element are sequentially aligned from a block in which writing is finished. Note that the period needed for alignment of the liquid crystal material is preferably long. The light source can be lit at the predetermined orientation of the liquid crystal material by ensuring a sufficient period, so that a liquid crystal display device with high display quality can be obtained.

FIG. 1B shows a period (the blocks 203A to 203C shown by oblique hatching) in which the light source is lit and which is followed by the period needed for alignment of the liquid crystal material of the liquid crystal element. The period shown in FIG. 1B in which the light source is lit is subsequently provided for all block which have undergone the period needed for alignment of the liquid crystal materials of the liquid crystal element after writing of the image signal in the first region A1 to the third region A3; so that the light source of a color component in accordance with the written image signal is lit.

Note that in FIG. 1B, a period in which the light source is lit in each block has the same length as a period which is needed for writing of an image signal in each block. The period in which the light source is lit in each block is preferably shorter than the period which is needed for writing of an image signal in each block. Shortening the period in which the light source is lit means shortening the period by taking into consideration lag of the periods due to delay of a signal or delay of response of a liquid crystal material. In the case where a period in which the light source is lit is shorter than a period which needed for writing of an image signal is in each block, periods in which the light sources are lit can be prevented from overlapping with each other at the time of switching left and right images.

In the first region A1 to the third region A3 shown in FIG. 1B, writing of an image signal in next sub-frame period is followed by sequential lighting of the light sources. The light sources are lit in accordance with writing of image signals in the first sub-frame period SF_1, the second sub-frame period SF_2, and the third sub-frame period SF_3.

Note that FIG. 1B shows F_0 as a period in which image signals are written for lighting of the light sources in the first region A1 to the third region A3. The image signals are written from a time Tg0 serving as a starting point, which is a time just before the first sub-frame period SF_1 of the first left eye frame period F_1L, to a time Tg1 serving as an ending point in the first sub-frame period SF_1. The period F_0 is provided for writing of an image signal for forming an image perceived by a left eye. Specifically, the period F_0 is preferably provided in the case where an image signal is not written in a sub-frame period of the previous frame period in the case of starting displaying an image at the time of switching the power on or the like.

Note that in the period just before the first sub-frame period SF_1, an image signal is written for the first sub-frame period SF_1, sequentially after an operation (here, lighting of the light source) performed in a period before the first sub-frame period SF_1. In other words, a period where light sources are not lit or a period for writing an image signal for displaying a black image is not provided between lighting of a light source and writing of an image signal. Note that a period in which the light source is lit may partly overlap with the period in which an image signal is written in the first sub-frame period SF_1. Note that such operation can be applied not only to the first sub-frame period SF_1 but also to the second sub-frame period SF_2 and the third sub-frame period SF_3.

In the above description, writing of an image signal, alignment of the liquid crystal material of the liquid crystal element, and lighting of the light source in the first region A1 to the third region A3 are explained. In the following description, features of the structure in this embodiment are explained.

In the structure of this embodiment illustrated in FIG. 1B, in the case of focusing on the first left eye frame period F_1L, lighting of the light source in the first region A1 to the third region A3 in a period from the time Tg1 serving as a starting point, which is a time just before the second sub-frame period SF_2, to a time Tg2 serving as an ending point in the second sub-frame period SF_2 is performed in accordance with an image signal written in the first sub-frame period SF_1 which begins from a time Ts1. Similarly, in the structure of this embodiment illustrated in FIG. 1B, lighting of the light source in the first region A1 to the third region A3 in a period from the time Tg2 serving as a starting point, which is a time just before the third sub-frame period SF_3, to a time Tg3 serving as an ending point in the third sub-frame period SF_3 is performed in accordance with an image signal written in the second sub-frame period SF_2 which begins from a time Ts2. Similarly, in the structure of this embodiment illustrated in FIG. 1B, lighting of the light source in the first region A1 to the third region A3 in a period from the time Tg0 serving as a starting point, which is a time just before the first sub-frame period SF_1, to the time Tg1 serving as an ending point in the first sub-frame period SF_1 is performed in accordance with an image signal written in the above period F_0. In the first right eye frame period F_1R, similarly, there is a time lag between writing of an image signal and lighting of the light source in accordance with the image signal.

Here, glasses with which images obtained by switching the lighting of the light sources of colors and by an additive color mixture can be perceived as left and right images switched by the frame sequential method are switched and are described. The additive colors are generated by lighting of the light source. The glasses with which an additive color mixture performed by lighting of the light source can be perceived include a portion (hereinafter referred to as a shutter for the left eye) which controls perception by a left eye and a portion (hereinafter referred to as a shutter for the right eye) which controls perception by a right eye. Note that perception by left and right eyes with the use of the glasses can be controlled by opening and closing of an optical shutter which is formed by a liquid crystal material or the like. The optical shutter can be open and closed in accordance with a switching timing of colors of the light source.

In the structure of this embodiment, the timing of perception performed by opening and closing of the optical shutter of the glasses with which stereoscopic vision is perceived by the frame sequential method is different from the timing in the first left eye frame period F_1L and the timing in the first right eye frame period F_1R. Specifically, in the case of focusing on the first left eye frame period F_1L, timing of open and shut in the shutter for the left eye and the shutter for the right eye is set to control open and shut of the optical shutter so that lighting of the light source from the time Tg0 to the time Tg3 is perceived as shown in FIG. 1B. After that, the optical shutter for the left eye and the optical shutter for the right eye are alternately opened and shut, repeatedly.

That is to say, switching timing of left and right images to be timing of opening and closing the optical shutter for the left eye and the optical shutter for the right eye can be performed in accordance with timing of lighting of the light source. Lighting of the light source can be performed at high speed, in several microseconds or less; as a result, in the structure of the embodiment, left and right images can be switched at high speed.

By the method for driving a liquid crystal display device in the above description, an image signal written to each pixel in sequential frame periods and lighting of the light source can be rearranged so as not to overlap with those in the previous frame period and the next frame period, so that writing of an image signal and lighting of the light source in accordance with the image signal can be performed. Therefore, by the driving method of a display device of this embodiment, a period in which the first left eye frame period F_1L and the first right eye frame period F_1R overlap with each other can be eliminated. Without the period in which the first left eye frame period F_1L and the first right eye frame period F_1R overlap with each other, crosstalk between consecutive frames can be reduced.

Note that opening and closing of the optical shutter for the left eye and the optical shutter for the right eye, which are described in FIG. 1B, can be performed in a period in which light sources of R, G, and B are sequentially lit in combination; accordingly, the period for opening and closing of the optical shutter for the left eye and the optical shutter for the right eye can be moved within a range in which light sources of R, G, and B are sequentially lit. Specifically, the structure may be illustrated in FIG. 3.

Figure 3:
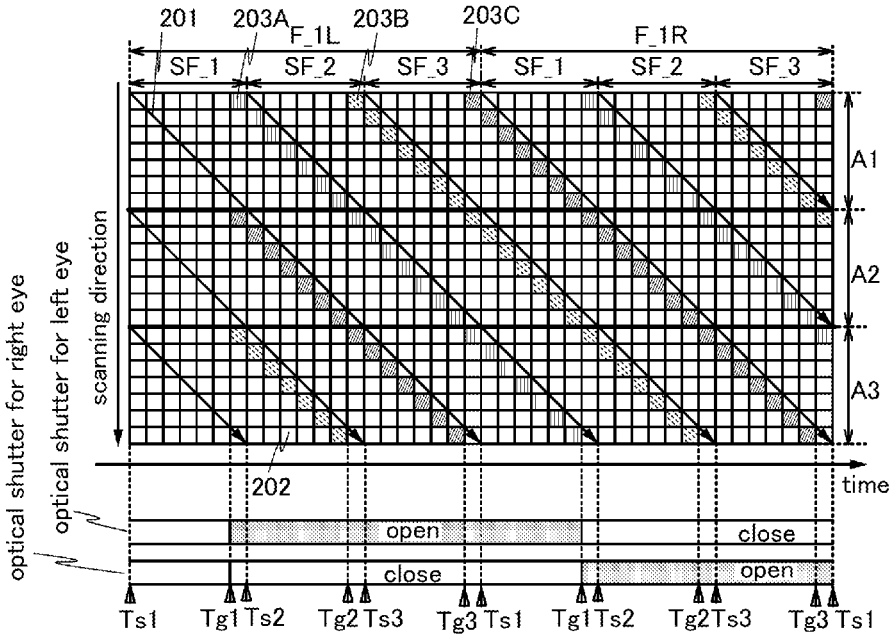
FIG. 3 is a diagram to describe the structure of Embodiment 1.

Similarly to FIG. 1B, FIG. 3 shows operation in sequential frames in which writing of an image signal, response of a liquid crystal element in accordance with the image signal, and lighting of the light source corresponding to a region to which the image signal is written are performed.

Unlike what is illustrated in FIG. 1B, the period F_0 illustrated in FIG. 1B is omitted, and timing of opening and closing in the shutter for the left eye and the shutter for the right eye is set to control opening and closing of the optical shutter so that lighting of the light source from the time Tg1 to the next time Tg1 is perceived as shown in FIG. 3. After that, the optical shutter for the left eye and the optical shutter for the right eye are alternately opened and shut, repeatedly.

In the structure illustrated in FIG. 3, in the case of focusing on the first left eye frame period F_1L, lighting of the light source in the first region A1 to the third region A3 in a period from the time Tg1 serving as a starting point, which is a time just before the second sub-frame period SF_2, to a time Tg2 serving as an ending point in the second sub-frame period SF_2 is performed in accordance with an image signal written in the first sub-frame period SF_1 which begins from a time Ts1. Similarly, in the structure of this embodiment illustrated in FIG. 3, lighting of the light source in the first region A1 to the third region A3 in a period from the time Tg2 serving as a starting point, which is a time just before the third sub-frame period SF_3, to a time Tg3 serving as an ending point in the third sub-frame period SF_3 is performed in accordance with an image signal written in the second sub-frame period SF_2 which begins from a time Ts2. Similarly, in the structure of this embodiment illustrated in FIG. 3, lighting of the light source in the first region A1 to the third region A3 in a period from the time Tg3 serving as a starting point, which is a time just before the first sub-frame period SF_1 in the first right eye frame period F_1R, to the time Tg1 serving as an ending point in the first sub-frame period SF_1 in the first right eye frame period F_1R is performed in accordance with an image signal written in the above period F_0. In the first right eye frame period F_1R, similarly, there is a time lag between writing of an image signal and lighting of the light source in accordance with the image signal.

In the structure in FIG. 3, periods for perception by left and right eyes with the use of the glasses with which stereoscopic vision is perceived by the frame sequential method are different from those in the above first left eye frame period F_1L and first right eye frame period F_1R. Specifically, in the case of focusing on the first left eye frame period F_1L, timing of opening and closing in the shutter for the left eye and the shutter for the right eye is set to control opening and closing of the optical shutter so that lighting of the light source from the time Tg1 to the next time Tg1 is perceived as shown in FIG. 1B. After that, the optical shutter for the left eye and the optical shutter for the right eye are alternately opened and shut, repeatedly.

That is to say, switching timing of left and right images to be timing of opening and closing the optical shutter for the left eye and the optical shutter for the right eye can be synchronized with timing of lighting of the light source. Lighting of the light source can be performed at high speed, in several microseconds or less; as a result, in the structure of the embodiment, left and right images can be switched at high speed.

By the above method for driving a liquid crystal display device, writing of an image signal to each pixel in sequential frame periods and lighting of the light source in accordance with the image signal can be performed so as not to overlap with those in the previous frame period and the next frame period. Therefore, by the driving method of a display device of this embodiment, a period in which the first left eye frame period F_1L and the first right eye frame period F_1R overlap with each other can be eliminated. Without the period in which the first left eye frame period F_1L and the first right eye frame period F_1R overlap with each other, crosstalk between consecutive frames can be reduced.

Note that in this embodiment, only an example of the order of writing of the RGB image signals and lighting of the RGB light sources in the first region A1 to the third region A3 to in the first frame period F_1 and the second frame period F_2 is illustrated; however, the order of RGB is not particularly limited. In other words, in a structure of this embodiment, a structure in which the light sources are turned on based on the writing of the R, G, and B image signals in one frame period is used.

In the structure of this embodiment as described above, the display device in which color display is performed by sequentially turning on the light sources of different colors by field sequential driving is described; however, a display device including writing of image signals and a display period corresponding to the writing is applicable to another structure. For example, a similar structure can be used for a display device including a color filter and a white light source, which can be realized by applying a structure of this embodiment in which any of RGB image signals of one region is written to a structure in which the image signals are written in one screen.

This embodiment can be implemented in appropriate combination with the structures described in the other embodiments.

Embodiment 2

In this embodiment, a structure for seeing a stereoscopic image using the driving method of a display device described in Embodiment 1 will be described.

Figure 4:
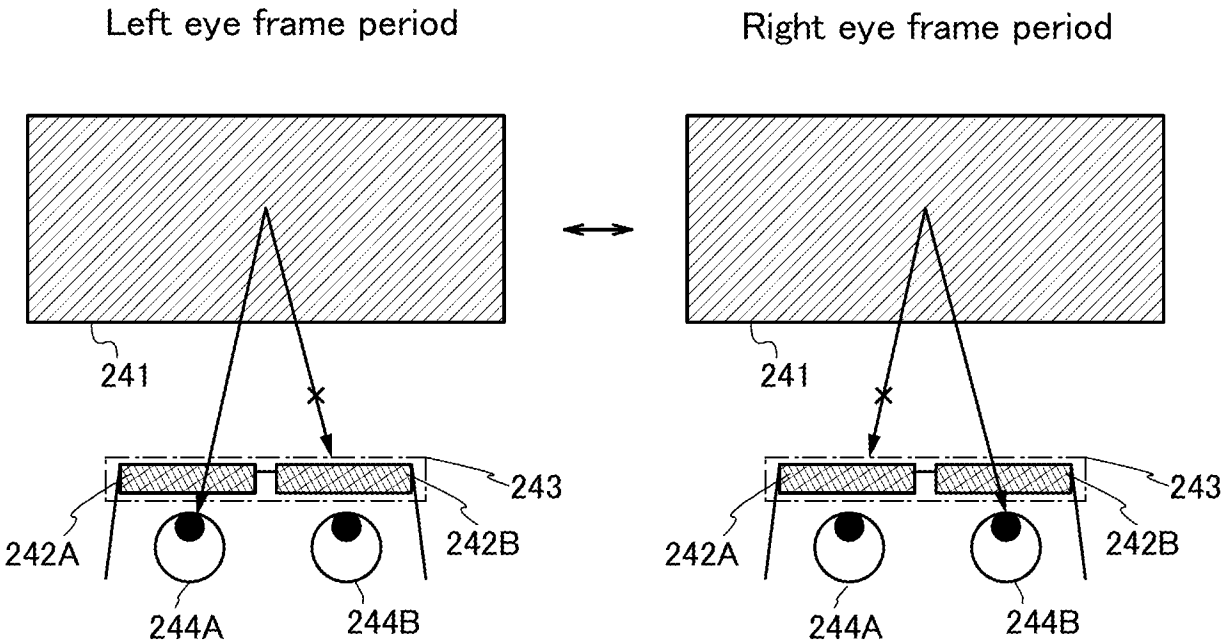
FIG. 4 is a diagram to describe the structure of Embodiment 2.

As illustrated in FIG. 4, an image for a left eye and an image for a right eye included in a display portion 241 of a display device in which any of the driving methods of a display device described in Embodiment 1 is performed is seen using glasses 243 including a left eye shutter 242A and a right eye shutter 242B, so that different images can be seen with a left eye 244A and a right eye 244B.

In other words, as illustrated in FIG. 4, in a left eye frame period, light from the display region, which enters the left eye, is transmitted through the left eye shutter 242A and no light from the display region, which enters the right eye 244B is transmitted through the right eye shutter 242B. In addition, in a right eye frame period, no light from the display region, which enters the left eye, is transmitted through the left eye shutter 242A, and light from the display region, which enters the right eye 244B, is transmitted through the right eye shutter 242B. A three-dimensional image is recognized by binocular disparity by a frame sequential method.

A structure of this embodiment as described above is combined with a structure of Embodiment 1, so that in the sub-frame periods in which the right and left images are switched and a stereoscopic image is displayed, crosstalk between the sub-frame periods in which the left image and the right image are displayed can be reduced.

This embodiment can be implemented in appropriate combination with the structures described in the other embodiments.

Embodiment 3

In this embodiment, a specific structure example of a method for driving a liquid crystal display device described in Embodiment 1 is described with reference to FIGS. 5A and 5B, FIGS. 6A to 6C, FIGS. 7A to 7D, FIGS. 8A and 8B, and FIG. 9. Note that a liquid crystal element is given as and example of a display element, but the display element may be an element which controls light transmission or no light transmission, and a micro electro mechanical system (MEMS) element, for example, may be used in addition to the liquid crystal element.

<Structure Example of Liquid Crystal Display Device>

Figure 5A:
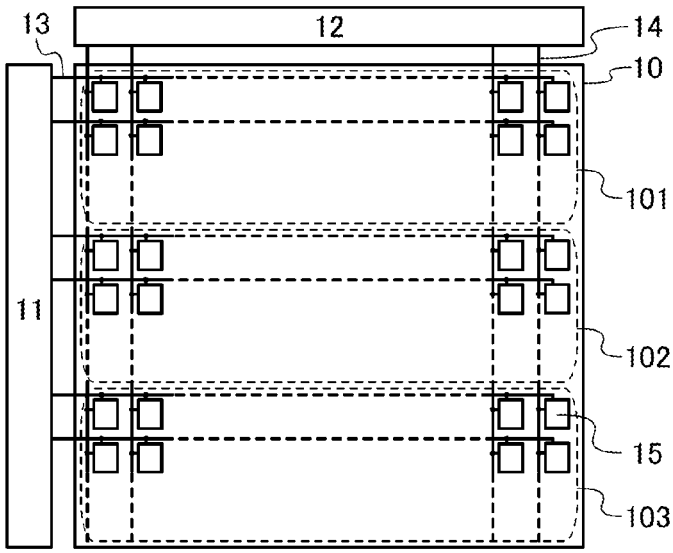
FIGS. 5A and 5B are diagrams to describe the structure of Embodiment 3.

FIG. 5A illustrates a structure example of a liquid crystal display device. The liquid crystal display device illustrated in FIG. 5A includes a pixel portion 10, a scan line driver circuit 11, a signal line driver circuit 12, m scan lines 13, and n signal lines 14. The pixel portion 10 is divided into three regions (regions 101 to 103), and each region includes a plurality of pixels arranged in a matrix. Each of the scan lines 13 is connected to the n pixels in the corresponding row, among the plurality of pixels arranged in m rows and n columns in the pixel portion 10. Each of the signal lines 14 is connected to the m pixels in the corresponding column, among the plurality of pixels arranged in the m rows and the n columns.

Figure 5B:
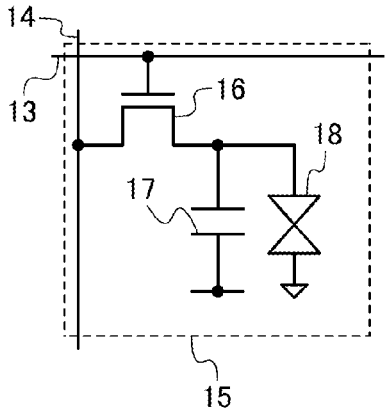

FIG. 5B illustrates an example of a circuit configuration of a pixel 15 included in the liquid crystal display device illustrated in FIG. 5A. The pixel 15 in FIG. 5B includes a transistor 16, a capacitor 17, and a liquid crystal element 18. A gate of the transistor 16 is connected to the scan line 13, and one of a source and a drain of the transistor 16 is connected to the signal line 14. One of electrodes of the capacitor 17 is connected to the other of the source and the drain of the transistor 16, and the other of the electrodes of the capacitor 17 is connected to a wiring for supplying a capacitor potential (the wiring is also referred to as a capacitor wiring). One of electrodes (also referred to as a pixel electrode) of the liquid crystal element 18 is connected to the other of the source and the drain of the transistor 16 and one of the electrodes of the capacitor 17, and the other of the electrodes (also referred to as a counter electrode) of the liquid crystal element 18 is connected to a wiring for supplying a counter potential. The transistor 16 is an n-channel transistor. The capacitor potential and the counter potential can be the same potential.

<Structure Example of Scan Line Driver Circuit 11>

Figure 6A:
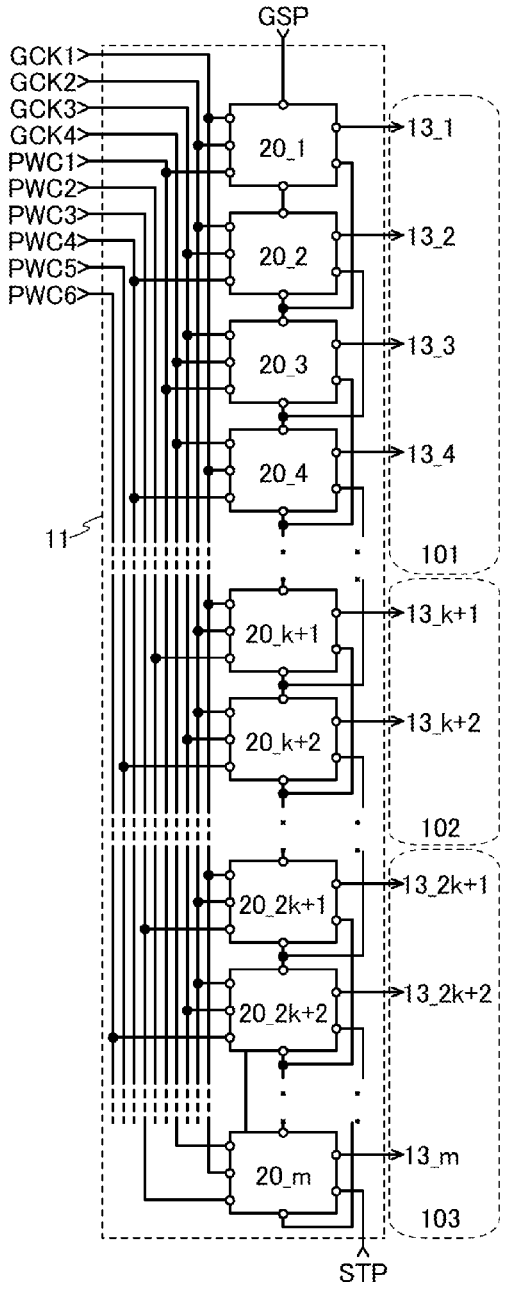
FIGS. 6A to 6C are diagrams to describe the structure of Embodiment 3.

FIG. 6A illustrates a structure example of the scan line driver circuit 11 included in the liquid crystal display device in FIG. 5A. The scan line driver circuit 11 illustrated in FIG. 6A includes: respective wirings for supplying first to fourth clock signals (GCK1 to GCK4) for the scan line driver circuit; respective wirings for supplying first to sixth pulse-width control signals (PWC1 to PWC6); and a first pulse output circuit 20_1 which is connected to the scan line 13_1 in the first row to an m-th pulse output circuit 20_*m* which is connected to the scan line 13_*m* in the m-th row. Note that here, the first pulse output circuit 20_1 to the k-th pulse output circuit 20_*k* (k is less than m/2 and a multiple of 4) are connected to the respective scan lines 13_1 to 13_*k* provided for the region 101; the (k+1)-th pulse output circuit 20_(k+1) to the 2k-th pulse output circuit 20_2*k* are connected to the respective scan lines 13_(k+1) to 13_2*k* provided for the region 102; and the (2k+1)-th pulse output circuit 20_(2k+1) to the m-th pulse output circuit 20_*m* are connected to the respective scan lines 13_(2k+1) to 13_*m* provided for the region 103. The first pulse output circuit 20_1 to the m-th pulse output circuit 20_*m* are configured to shift a shift pulse sequentially per shift period in response to a start pulse (GSP) for the scan line driver circuit which is input to the first pulse output circuit 20_1. Note that a plurality of shift pulses can be shifted in parallel in the first pulse output circuit 20_1 to the m-th pulse output circuit 20_*m*. In other words, even in a period in which a shift pulse is shifted in the first pulse output circuit 20_1 to the m-th pulse output circuit 20_*m*, the start pulse (GSP) for the scan line driver circuit can be input to the first pulse output circuit 20_1.

Figure 6B:
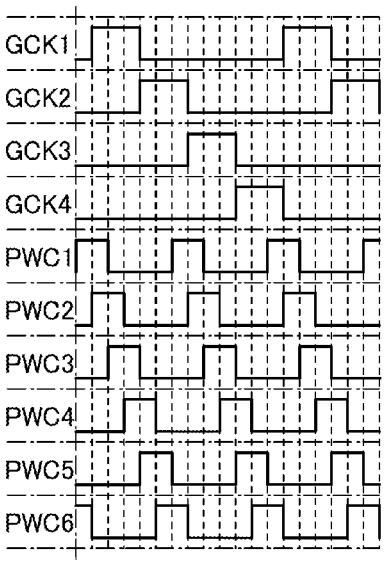

FIG. 6B illustrates examples of specific waveforms of the above-described signals. The first clock signal (GCK1) for the scan line driver circuit in FIG. 6B periodically repeats a high-level potential (high power supply potential (Vdd)) and a low-level potential (low power supply potential (Vss)), and has a duty ratio of ¼. The second clock signal (GCK2) for the scan line driver circuit is a signal whose phase is deviated by ¼ period from the first clock signal (GCK1) for the scan line driver circuit; the third clock signal (GCK3) for the scan line driver circuit is a signal whose phase is deviated by ½ period from the first clock signal (GCK1) for the scan line driver circuit; and the fourth clock signal (GCK4) for the scan line driver circuit is a signal whose phase is deviated by ¾ period from the first clock signal (GCK1) for the scan line driver circuit. The first pulse-width control signal (PWC1) periodically repeats the high-level potential (high power supply potential (Vdd)) and the low-level potential (low power supply potential (Vss)), and has a duty ratio of ⅓. The second pulse-width control signal (PWC2) is a signal whose phase is deviated by ⅙ period from the first pulse-width control signal (PWC1); the third pulse-width control signal (PWC3) is a signal whose phase is deviated by ⅓ period from the first pulse-width control signal (PWC1); the fourth pulse-width control signal (PWC4) is a signal whose phase is deviated by ½ period from the first pulse-width control signal (PWC1); the fifth pulse-width control signal (PWCS) is a signal whose phase is deviated by ⅔ period from the first pulse-width control signal (PWC1); and the sixth pulse-width control signal (PWC6) is a signal whose phase is deviated by ⅚ period from the first pulse-width control signal (PWC1). Note that here, the ratio of the pulse width of each of the first to fourth clock signals (GCK1 to GCK4) for the scan line driver circuit, to the pulse width of each of the first to sixth pulse-width control signals (PWC1 to PWC6) is 3:2.

In the above-described liquid crystal display device, the same configuration can be applied to the first pulse output circuit 20_1 to the m-th pulse output circuit 20_*m*. However, electrical connections of a plurality of terminals included in the pulse output circuit differ depending on the pulse output circuits. Specific connection relation will be described with reference to FIGS. 6A and 6C.

Each of the first pulse output circuit 20_1 to the m-th pulse output circuit 20_*m* has terminals 21 to 27. The terminals 21 to 24 and the terminal 26 are input terminals; the terminals 25 and 27 are output terminals.

First, the terminal 21 will be described. The terminal 21 of the first pulse output circuit 20_1 is connected to a wiring for supplying the start pulse (GSP) for the scan line driver circuit. The terminal 21 of the second pulse output circuit 20_2 to the m-th pulse output circuit 20_*m* are connected to respective terminals 27 of their respective previous-stage pulse output circuits.

Next, the terminal 22 will be described. The terminal 22 of the (4a−3)-th pulse output circuit (a is a natural number less than or equal to m/4) is connected to the wiring for supplying the first clock signal (GCK1) for the scan line driver circuit. The terminal 22 of the (4a−2)-th pulse output circuit is connected to the wiring for supplying the second clock signal (GCK2) for the scan line driver circuit. The terminal 22 of the (4a−1)-th pulse output circuit is connected to the wiring for supplying the third clock signal (GCK3) for the scan line driver circuit. The terminal 22 of the 4a-th pulse output circuit is connected to the wiring for supplying the fourth clock signal (GCK4) for the scan line driver circuit.

Then, the terminal 23 will be described. The terminal 23 of the (4a−3)-th pulse output circuit is connected to the wiring for supplying the second clock signal (GCK2) for the scan line driver circuit. The terminal 23 of the (4a−2)-th pulse output circuit is connected to the wiring for supplying the third clock signal (GCK3) for the scan line driver circuit. The terminal 23 of the (4a−1)-th pulse output circuit is connected to the wiring for supplying the fourth clock signal (GCK4) for the scan line driver circuit. The terminal 23 of the 4a-th pulse output circuit is connected to the wiring for supplying the first clock signal (GCK1) for the scan line driver circuit.

Next, the terminal 24 will be described. The terminal 24 of the (2b−1)-th pulse output circuit (b is a natural number less than or equal to k/2) is connected to the wiring for supplying the first pulse-width control signal (PWC1). The terminal 24 of the 2b-th pulse output circuit is connected to the wiring for supplying the fourth pulse-width control signal (PWC4). The terminal 24 of the (2c−1)-th pulse output circuit (c is a natural number greater than or equal to (k/2+1) and less than or equal to k) is connected to the wiring for supplying the second pulse-width control signal (PWC2). The terminal 24 of the 2c-th pulse output circuit is connected to the wiring for supplying the fifth pulse-width control signal (PWC5). The terminal 24 of the (2d−1)-th pulse output circuit (d is a natural number greater than or equal to (k+1) and less than or equal to m/2) is connected to the wiring for supplying the third pulse-width control signal (PWC3). The terminal 24 of the 2d-th pulse output circuit is connected to the wiring for supplying the sixth pulse-width control signal (PWC6).

Then, the terminal 25 will be described. The terminal 25 of the x-th pulse output circuit (x is a natural number less than or equal to m) is connected to the scan line 13_*x* in the x-th row.

Next, the terminal 26 will be described. The terminal 26 of the y-th pulse output circuit (y is a natural number less than or equal to m−1) is connected to the terminal 27 of the (y+1)-th pulse output circuit. The terminal 26 of the m-th pulse output circuit is connected to a wiring for supplying a stop signal (STP) for the m-th pulse output circuit. In the case where a (m+1)-th pulse output circuit is provided, the stop signal (STP) for the m-th pulse output circuit corresponds to a signal output from the terminal 27 of the (m+1)-th pulse output circuit. Specifically, the stop signal (STP) for the m-th pulse output circuit can be supplied to the m-th pulse output circuit by the (m+1)-th pulse output circuit provided as a dummy circuit or by inputting the signal directly from the outside.

Connection relation of the terminal 27 of each pulse output circuit is described above. Therefore, the above description is to be referred to.

<Structure Example of Pulse Output Circuit>

Figure 6C:
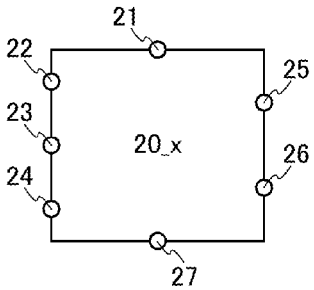
Figure 7A:
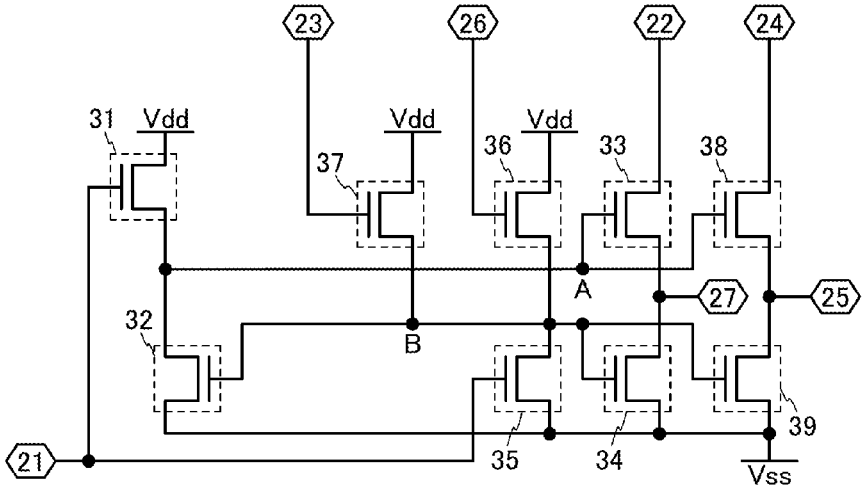
FIGS. 7A to 7D are diagrams to describe the structure of Embodiment 3.

FIG. 7A illustrates a structure example of the pulse output circuit illustrated in FIGS. 6A and 6C. A pulse output circuit illustrated in FIG. 7A includes transistors 31 to 39.

One of a source and a drain of the transistor 31 is connected to a wiring for supplying the high power supply potential (Vdd) (hereinafter also referred to as a high power supply potential line). A gate of the transistor 31 is connected to the terminal 21.

One of a source and a drain of the transistor 32 is connected to a wiring for supplying the low power supply potential (Vss) (hereinafter also referred to as a low power supply potential line). The other of the source and the drain of the transistor 32 is connected to the other of the source and the drain of the transistor 31.

One of a source and a drain of the transistor 33 is connected to the terminal 22. The other of the source and the drain of the transistor 33 is connected to the terminal 27. A gate of the transistor 33 is connected to the other of the source and the drain of the transistor 31 and the other of the source and the drain of the transistor 32.

One of a source and a drain of the transistor 34 is connected to the low power supply potential line. The other of the source and the drain of the transistor 34 is connected to the terminal 27. A gate of the transistor 34 is connected to the gate of the transistor 32.

One of a source and a drain of the transistor 35 is connected to the low power supply potential line. The other of the source and the drain of the transistor 35 is connected to the gate of the transistor 32 and the gate of the transistor 34. A gate of the transistor 35 is connected to the terminal 21.

One of a source and a drain of the transistor 36 is connected to the high power supply potential line. The other of the source and the drain of the transistor 36 is connected to the gate of the transistor 32, the gate of the transistor 34, and the other of the source and the drain of the transistor 35. A gate of the transistor 36 is connected to the terminal 26. Note that it is possible to employ a structure in which one of the source and the drain of the transistor 36 is connected to a wiring for supplying a power supply potential (Vcc) which is higher than the low power supply potential (Vss) and lower than the high power supply potential (Vdd).

One of a source and a drain of the transistor 37 is connected to the high power supply potential line. The other of the source and the drain of the transistor 37 is connected to the gate of the transistor 32, the gate of the transistor 34, the other of the source and the drain of the transistor 35, and the other of the source and the drain of the transistor 36. A gate of the transistor 37 is connected to the terminal 23. Note that it is possible to employ a structure in which one of the source and the drain of the transistor 37 is connected to a wiring for supplying the power supply potential (Vcc).

One of a source and a drain of the transistor 38 is connected to the terminal 24. The other of the source and the drain of the transistor 38 is connected to the terminal 25. A gate of the transistor 38 is connected to the other of the source and the drain of the transistor 31, the other of the source and the drain of the transistor 32, and the gate of the transistor 33.

One of a source and a drain of the transistor 39 is connected to the low power supply potential line. The other of the source and the drain of the transistor 39 is connected to the terminal 25. A gate of the transistor 39 is connected to the gate of the transistor 32, the gate of the transistor 34, the other of the source and the drain of the transistor 35, the other of the source and the drain of the transistor 36, and the other of the source and the drain of the transistor 37.

In the following description, a node where the other of the source and the drain of the transistor 31, the other of the source and the drain of the transistor 32, the gate of the transistor 33, and the gate of the transistor 38 are connected to each other is referred to as a node A; a node where the gate of the transistor 32, the gate of the transistor 34, the other of the source and the drain of the transistor 35, the other of the source and the drain of the transistor 36, the other of the source and the drain of the transistor 37, and the gate of the transistor 39 are connected to each other is referred to as a node B.

<Operation Example of Pulse Output Circuit>

Figure 7B:
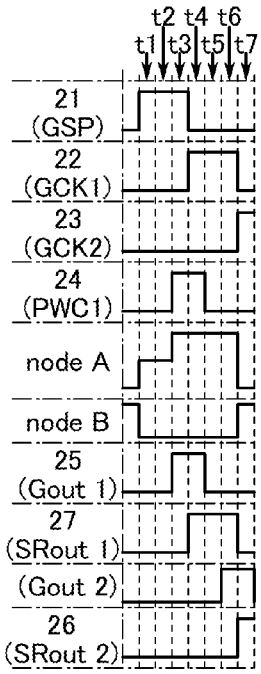
Figure 7C:
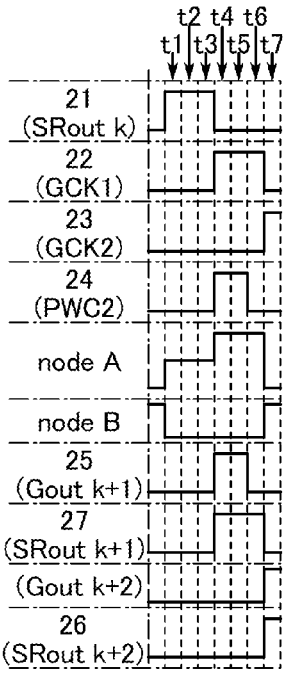
Figure 7D:
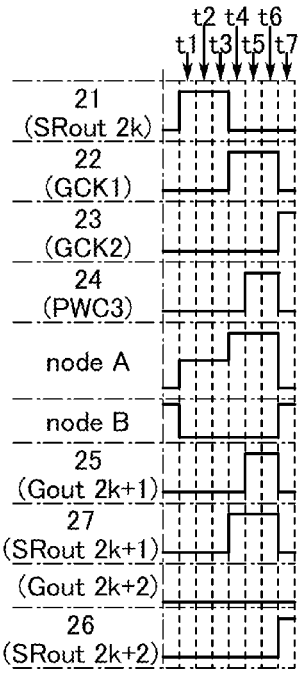

An operation example of the above-described pulse output circuit will be described with reference to FIGS. 7B to 7D. Described here is an operation example in the case where timing of inputting the start pulse (GSP) for the scan line driver circuit to the terminal 21 of the first pulse output circuit 20_1 is controlled such that shift pulses are output from the terminals 27 of the first pulse output circuit 20_1, the (k+1)-th pulse output circuit 20_(k+1), and the (2k+1)-th pulse output circuit 20_(2k+1) at the same timing. Specifically, the potentials of the signals which are input to the terminals of the first pulse output circuit 20_1 and the potentials of the node A and the node B when the start pulse (GSP) for the scan line driver circuit is input are illustrated in FIG. 7B; the potentials of the signals which are input to the terminals of the (k+1)-th pulse output circuit 20_(k+1) and the potentials of the node A and the node B when the high-level potential is input from the k-th pulse output circuit 20_*k* are illustrated in FIG. 7C; and the potentials of the signals which are input to the terminals of the (2k+1)-th pulse output circuit 20_(2k+1) and the potentials of the node A and the node B when the high-level potential is input from the 2k-th pulse output circuit 20_2*k* are illustrated in FIG. 7D. In FIGS. 7B to 7D, the signals which are input to the terminals are each provided in parentheses. In addition, the signal (Gout 2, Gout k+2, Gout 2k+2) which is output from the terminal 25 of the subsequent-stage pulse output circuit (the second pulse output circuit 20_2, the (k+2)-th pulse output circuit 20_(k+2), the (2k+2)-th pulse output circuit 20_(2k+2)), and the signal (SRout 2: input signal of the terminal 26 of the first pulse output circuit 20_1, SRout k+2: input signal of the terminal 26 of the (k+1)-th pulse output circuit 20_(k+1), SRout 2k+2: input signal of the terminal 26 of the (2k+1)-th pulse output circuit 20_(2k+1)) output from the terminal 27 of the subsequent-stage pulse output circuit are also illustrated. Note that in FIGS. 7B to 7D, Gout represents an output signal from the pulse output circuit to the scan line, and SRout represents an output signal from the pulse output circuit to the pulse output circuit in the subsequent stage.

First, the case where the high-level potential is input as the start pulse (GSP) for the scan line driver circuit to the first pulse output circuit 20_1 will be described with reference to FIG. 7B.

In a period t1, the high-level potential (high power supply potential (Vdd)) is input to the terminal 21. Thus, the transistors 31 and 35 are on. As a result, the potential of the node A is increased to the high-level potential (potential that is decreased from the high power supply potential (Vdd) by the threshold voltage of the transistor 31), and the potential of the node B is decreased to the low power supply potential (Vss), so that the transistors 33 and 38 are on and the transistors 32, 34, and 39 are off. Thus, in the period t1, a signal output from the terminal 27 is a signal input to the terminal 22, and a signal output from the terminal 25 is a signal input to the terminal 24. Here in the period t1, both the signal input to the terminal 22 and the signal input to the terminal 24 are at the low-level potential (low power supply potential (Vss)). Accordingly, in the period t1, the first pulse output circuit 20_1 outputs the low-level potential (low power supply potential (Vss)) to the terminal 21 of the second pulse output circuit 20_2 and the scan line in the first row in the pixel portion.

In a period t2, the levels of the signals input to the terminals are the same as in the period t1. Therefore, the potentials of the signals output from the terminals 25 and 27 are also not changed; the low-level potentials (low power supply potentials (Vss)) are output.

In a period t3, the high-level potential (high power supply potential (Vdd)) is input to the terminal 24. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is off. At this time, the input of the high-level potential (high power supply potential (Vdd)) to the terminal 24 further increases the potential of the node A (the potential of the gate of the transistor 38) by capacitive coupling between the source and the gate of the transistor 38 (bootstrapping). Owing to the bootstrapping, the potential of the signal output from the terminal 25 is not decreased from the high-level potential (high power supply potential (Vdd)) input to the terminal 24. Accordingly, in the period t3, the first pulse output circuit 20_1 outputs the high-level potential (high power supply potential (Vdd)=a selection signal) to the scan line in the first row in the pixel portion.

In a period t4, the high-level potential (high power supply potential (Vdd)) is input to the terminal 22. As a result, since the potential of the node A has been increased by the bootstrapping, the potential of the signal output from the terminal 27 is not decreased from the high-level potential (high power supply potential (Vdd)) input to the terminal 22. Accordingly, in the period t4, the terminal 27 outputs the high-level potential (high power supply potential (Vdd)) which is input to the terminal 22. In other words, the first pulse output circuit 20_1 outputs the high-level potential (high power supply potential (Vdd)=a shift pulse) to the terminal 21 of the second pulse output circuit 20_2. In the period t4 also, the signal input to the terminal 24 maintains the high-level potential (high power supply potential (Vdd)), so that the signal output to the scan line in the first row in the pixel portion from the first pulse output circuit 20_1 remains at the high-level potential (high power supply potential (Vdd)=the selection signal). Further, the low-level potential (low power supply potential (Vss)) is input to the terminal 21 to turn off the transistor 35, which does not directly influence the output signal of the pulse output circuit in the period t4.

In a period t5, the low-level potential (low power supply potential (Vss)) is input to the terminal 24. In that period, the transistor 38 maintains the on state. Accordingly, in the period t5, the first pulse output circuit 20_1 outputs the low-level potential (low power supply potential (Vss)) to the scan line arranged in the first row in the pixel portion.

In a period t6, the levels of the signals input to the terminals are the same as in the period t5. Therefore, the potentials of the signals output from the terminals 25 and 27 are also not changed; the low-level potential (low power supply potentials (Vss)) is output from the terminal 25 and the high-level potential (high power supply potential (Vdd)=the shift pulse) is output from the terminal 27.

In a period t7, the high-level potential (high power supply potential (Vdd)) is input to the terminal 23. Thus, the transistor 37 is on. As a result, the potential of the node B is increased to the high-level potential (potential that is decreased from the high power supply potential (Vdd) by the threshold voltage of the transistor 37). In other words, the transistors 32, 34, and 39 are on. On the other hand, the potential of the node A is decreased to the low-level potential (low power supply potential (Vss)). In other words, the transistors 33 and 38 are off. Accordingly, in the period t7, both of the signals output from the terminals 25 and 27 are at the low power supply potentials (Vss). In other words, in the period t7, the first pulse output circuit 20_1 outputs the low power supply potential (Vss) to the terminal 21 of the second pulse output circuit 20_2 and the scan line arranged in the first row in the pixel portion.

Next, the case where the high-level potential is input as the shift pulse from the k-th pulse output circuit 20_*k* to the terminal 21 of the (k+1)-th pulse output circuit 20_(k+1) will be described with reference to FIG. 7C.

Operation of the (k+1)-th pulse output circuit 20_(k+1) is as of the first pulse output circuit 20_1 in the periods t1 and t2. Therefore, the above description is to be referred to.

In the period t3, the levels of the signals input to the terminals are the same as in the period t2. Therefore, the potentials of the signals output from the terminals 25 and 27 are also not changed; the low-level potentials (low power supply potentials (Vss)) are output.

In the period t4, the high-level potentials (high power supply potentials (Vdd)) are input to the terminals 22 and 24. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is off in the period t1. The input of the high-level potentials (high power supply potentials (Vdd)) to the terminals 22 and 24 further increases the potential of the node A (the potentials of the gates of the transistors 33 and 38) by capacitive coupling between the source and the gate of the transistor 33 and capacitive coupling between the source and the gate of the transistor 38 (bootstrapping). Owing to the bootstrapping, the potentials of the signals output from the terminals 25 and 27 are not decreased from the high-level potentials (high power supply potentials (Vdd)) input to the terminals 22 and 24, respectively. Accordingly, in the period t4, the (k+1)-th pulse output circuit 20_(k+1) outputs the high-level potentials (high power supply potentials (Vdd)=a selection signal and a shift pulse) to the scan line in the (k+1)-th row in the pixel portion and the terminal 21 of the (k+2)-th pulse output circuit 20_(k+2).

In the period t5, the levels of the signals input to the terminals are the same as in the period t4. Therefore, the potentials of the signals output from the terminals 25 and 27 are also not changed; the high-level potentials (high power supply potentials (Vdd)=the selection signal and the shift pulse) are output.

In the period t6, the low-level potential (low power supply potential (Vss)) is input to the terminal 24. In that period, the transistor 38 maintains the on state. Accordingly, in the period t6, the (k+1)-th pulse output circuit 20_(k+1) outputs the low-level potential (low power supply potential (Vss)) to the scan line arranged in the (k+1)-th row in the pixel portion.

In the period t7, the high-level potential (high power supply potential (Vdd)) is input to the terminal 23. Thus, the transistor 37 is on. As a result, the potential of the node B is increased to the high-level potential (potential that is decreased from the high power supply potential (Vdd) by the threshold voltage of the transistor 37). In other words, the transistors 32, 34, and 39 are on. On the other hand, the potential of the node A is decreased to the low-level potential (low power supply potential (Vss)). In other words, the transistors 33 and 38 are off. Accordingly, in the period t7, both of the signals output from the terminals 25 and 27 are at the low power supply potentials (Vss). In other words, in the period t7, the (k+1)-th pulse output circuit 20_(k+1) outputs the low power supply potential (Vss) to the terminal 21 of the (k+2)-th pulse output circuit 20_(k+2) and the scan line arranged in the (k+1)-th row in the pixel portion.

Next, the case where the high-level potential is input as the shift pulse from the 2k-th pulse output circuit 20_2*k* to the terminal 21 of the (2k+1)-th pulse output circuit 20_(2k+1) will be described below with reference to FIG. 7D.

Operation of the (2k+1)-th pulse output circuit 20_(2k+1) is as of the (k+1)-th pulse output circuit 20_(k+1) in the periods t1 to t3. Therefore, the above description is to be referred to.

In the period t4, the high-level potential (high power supply potential (Vdd)) is input to the terminal 22. Note that the potential of the node A (the source potential of the transistor 31) has been increased to the high-level potential (potential that is decreased from the high power supply potential (Vdd) by the threshold voltage of the transistor 31) in the period t1.

Therefore, the transistor 31 is off in the period t1. The input of the high-level potential (high power supply potential (Vdd)) to the terminal 22 further increases the potential of the node A (the potential of the gate of the transistor 33) by capacitive coupling between the source and the gate of the transistor 33 (bootstrapping). Owing to the bootstrapping, the potential of the signal output from the terminal 27 is not decreased from the high-level potential (high power supply potential (Vdd)) input to the terminal 22. Accordingly, in the period t4, the (2k+1)-th pulse output circuit 20_(2k+1) outputs the high-level potential (high power supply potential (Vdd)=a shift pulse) to the terminal 21 of the (2k+2)-th pulse output circuit 20_(2k+2). Further, the low-level potential (low power supply potential (Vss)) is input to the terminal 21 to turn off the transistor 35, which does not directly influence the output signal of the pulse output circuit in the period t4.

In the period t5, the high-level potential (high power supply potential (Vdd)) is input to the terminal 24. As a result, since the potential of the node A has been increased by the bootstrapping, the potential of the signal output from the terminal 25 is not decreased from the high-level potential (high power supply potential (Vdd)) input to the terminal 24. Accordingly, in the period t5, the terminal 25 outputs the high-level potential (high power supply potential (Vdd)) which is input to the terminal 22. In other words, the (2k+1)-th pulse output circuit 20_(2k+1) outputs the high-level potential (high power supply potential (Vdd)=a selection signal) to the scan line arranged in the (2k+1)-th row in the pixel. In the period t5 also, the signal input to the terminal 22 maintains the high-level potential (high power supply potential (Vdd)), so that the signal output from the (2k+1)-th pulse output circuit 20_(2k+1) to the terminal 21 of the (2k+2)-th pulse output circuit 20_(2k+2) remains at the high-level potential (high power supply potential (Vdd)=the shift pulse).

In the period t6, the levels of the signals input to the terminals are the same as in the period t5. Therefore, the potentials of the signals output from the terminals 25 and 27 are also not changed; the high-level potentials (high power supply potentials (Vdd)=the selection signal and the shift pulse) are output.

In the period t7, the high-level potential (high power supply potential (Vdd)) is input to the terminal 23. Thus, the transistor 37 is on. As a result, the potential of the node B is increased to the high-level potential (potential that is decreased from the high power supply potential (Vdd) by the threshold voltage of the transistor 37). In other words, the transistors 32, 34, and 39 are on. On the other hand, the potential of the node A is decreased to the low-level potential (low power supply potential (Vss)). In other words, the transistors 33 and 38 are off. Accordingly, in the period t7, both of the signals output from the terminals 25 and 27 are at the low power supply potential (Vss). In other words, in the period t7, the (2k+1)-th pulse output circuit 20_(2k+1) outputs the low power supply potential (Vss) to the terminal 21 of the (2k+2)-th pulse output circuit 20_(2k+2) and the scan line arranged in the (2k+1)-th row in the pixel portion.

As illustrated in FIGS. 7B to 7D, with the first pulse output circuit 20_1 to the m-th pulse output circuit 20_*m*, a plurality of shift pulses can be shifted in parallel by controlling the timing of inputting the start pulse (GSP) for the scan line driver circuit. Specifically, after the start pulse (GSP) for the scan line driver circuit is input, the start pulse (GSP) for the scan line driver circuit is input again at the timing at which the terminal 27 of the k-th pulse output circuit 20_*k* outputs a shift pulse, whereby shift pulses can be output from the first pulse output circuit 20_1 and the (k+1)-th pulse output circuit 20_(k+1) at the same timing. The start pulse (GSP) for the scan line driver circuit can be further input in a similar manner, whereby shift pulses can be output from the first pulse output circuit 20_1, the (k+1)-th pulse output circuit 20_(k+1), and the (2k+1)-th pulse output circuit 20_(2k+1) at the same timing.

In addition, the first pulse output circuit 20_1, the (k+1)-th pulse output circuit 20_(k+1), and the (2k+1)-th pulse output circuit 20_(2k+1) can supply selection signals to respective scan lines at different timings in parallel to the above-described operation. In other words, with the scan line driver circuit, a plurality of shift pulses including a specific shift period can be shifted several times, and a plurality of pulse output circuits to which shift pulses are input at the same timing can supply selection signals to their respective scan lines at different timings.

<Structure Example of Signal Line Driver Circuit 12>

Figure 8A:
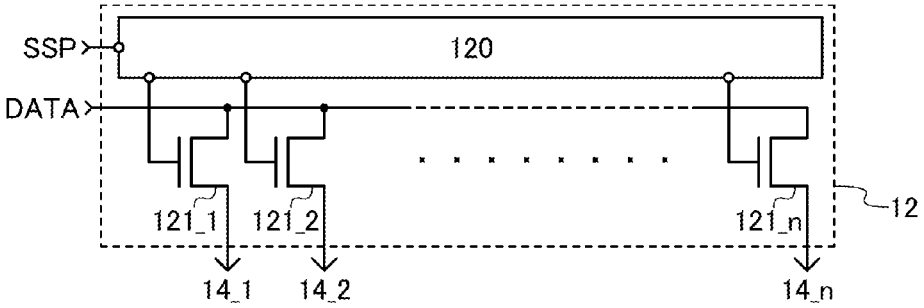
FIGS. 8A and 8B are diagrams to describe the structure of Embodiment 3.

FIG. 8A illustrates a structure example of the signal line driver circuit 12 included in the liquid crystal display device in FIG. 5A. The signal line driver circuit 12 illustrated in FIG. 8A includes a shift register 120 having first to n-th output terminals, a wiring for supplying an image signal (DATA), and transistors 121_1 to 121_*n*. One of a source and a drain of the transistor 121_1 is connected to the wiring for supplying the image signal (DATA), the other of the source and the drain of the transistor 121_1 is connected to the signal line 14_1 in the first column in the pixel portion, and a gate of the transistor 121_1 is connected to the first output terminal of the shift register 120. One of a source and a drain of the transistor 121_*n* is connected to the wiring for supplying the image signal (DATA), the other of the source and the drain of the transistor 121_*n* is connected to the signal line 14_*n* in the n-th column in the pixel portion, and a gate of the transistor 121_*n* is connected to the n-th output terminal of the shift register 120. The shift register 120 outputs the high-level potential sequentially from the first to n-th output terminals per shift period, when a high-level potential is input as a start pulse for the signal line driver circuit (SSP). In other words, the transistors 121_1 to 121_*n* are sequentially turned on per shift period.

Figure 8B:
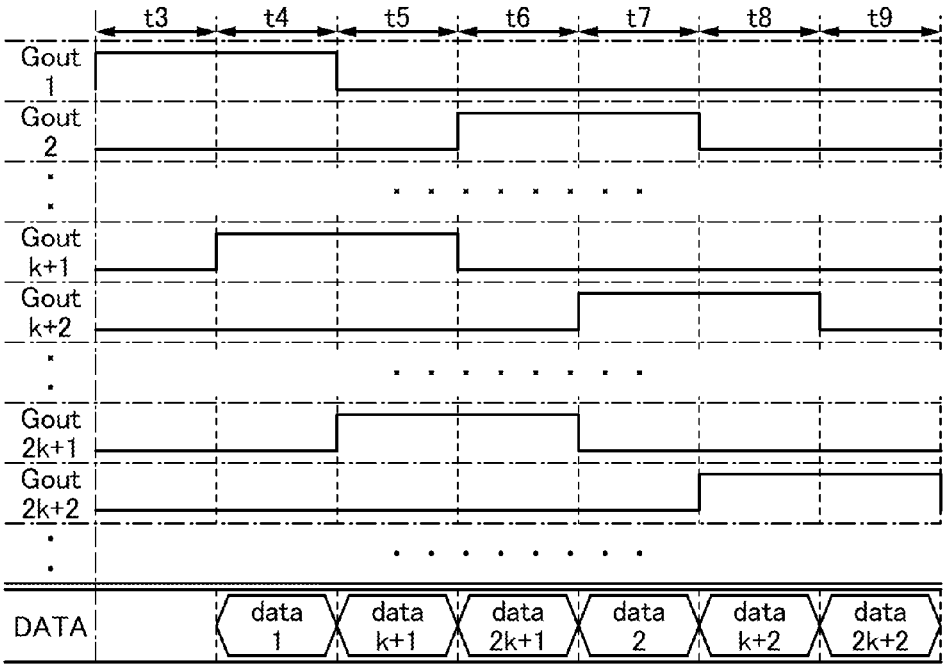

FIG. 8B illustrates an example of timing of image signals which are supplied through the wiring for supplying the image signal (DATA). As illustrated in FIG. 8B, the wiring for supplying the image signal (DATA) supplies an image signal for a pixel provided in the first row (data 1) in the period t4; an image signal for a pixel provided in the (k+1)-th row (data k+1) in the period t5; an image signal for a pixel provided in the (2k+1)-th row (data 2k+1) in the period t6; and an image signal for a pixel provided in the second row (data 2) in the period t7. In this manner, the wiring for supplying the image signal (DATA) supplies image signals for pixels arranged in respective rows sequentially. Specifically, image signals are supplied in the following order: an image signal for a pixel provided in the s-th row (s is a natural number less than k)→an image signal for a pixel provided in the (k+s)-th row→an image signal for a pixel provided in the (2k+s)-th row→an image signal for a pixel provided in the (s+1)-th row. According to the above-described operation of the scan line driver circuit and the signal line driver circuit, the image signals can be input to the pixels in three rows provided in the pixel portion per shift period of the pulse output circuit in the scan line driver circuit.

<Structure Example of Backlight>

Figure 9:
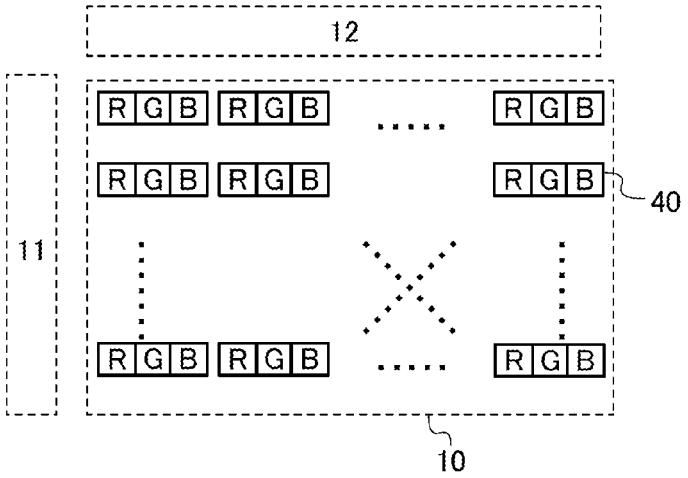
FIG. 9 is a diagram to describe the structure of Embodiment 3.

FIG. 9 illustrates a structure example of a backlight provided behind the pixel portion 10 in the liquid crystal display device illustrated in FIG. 5A. The backlight illustrated in FIG. 9 includes a plurality of backlight units 40 each including a light source that emits red (R) light, a light source that emits green (G) light, and a light source that emits blue (B) light. The plurality of backlight units 40 is arranged in a matrix, and can be controlled to be turned on per unit region. Here, the backlight units 40 are provided at least every t rows and n columns (here, t is k/4) as the backlight for the plurality of pixels 15 provided in the m rows and the n columns, and lighting of the backlight units 40 can be controlled independently. In other words, the backlight includes at least a backlight unit for the first to t-th rows to a backlight unit for the (2k+3t+1)-th to m-th rows, and the lighting of the backlight units 40 can be controlled independently. Further, in the backlight unit 40, the lighting of each of the light source that emits red (R) light, the light source that emits green (G) light, and the light source that emits blue (B) light can also be controlled independently. In other words, in the backlight unit 40, red (R) light, green (G) light, or blue (B) light can be delivered to the pixel portion 10 by turning on any one of the light source that emits red (R) light, the light source that emits green (G) light, and the light source that emits blue (B) light; mixed color light formed by a mixture of lights of two colors can be delivered to the pixel portion 10 by turning on any two of the light source that emits red (R) light, the light source that emits green (G) light, and the light source that emits blue (B) light; and white (W) light formed by a mixture of lights of three colors can be delivered to the pixel portion 10 by turning on all the light source that emits red (R) light, the light source that emits green (G) light, and the light source that emits blue (B) light.

According to the above structure, the method for driving the liquid crystal display device in Embodiment 1 can be used.

This embodiment can be implemented in appropriate combination with the structures described in the other embodiments.

Embodiment 4

In this embodiment, an example of a block diagram for driving a liquid crystal display device will be described.

Figure 10:
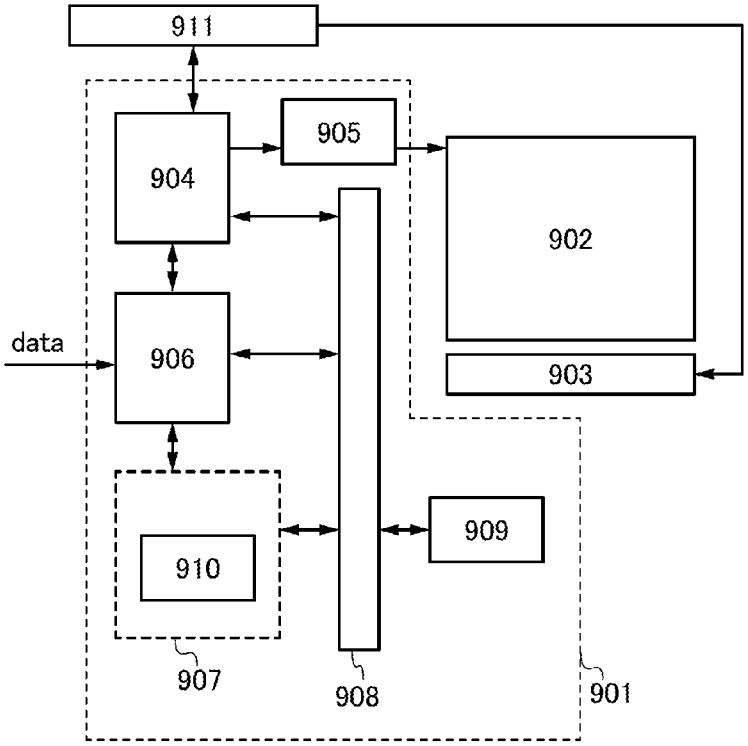
FIG. 10 is a diagram to describe the structure of Embodiment 4.

In a block diagram in FIG. 10, an image signal processing circuit 901, a display panel 902, and a backlight unit 903 are illustrated.

The image signal processing circuit 901 includes a display control circuit 904, a panel control circuit 905, a format conversion circuit 906, a 2D/3D image signal conversion circuit 907, a memory control circuit 908, and a frame memory 909.

In the image signal processing circuit 901, an image signal (data) is supplied to the format conversion circuit 906 from the outside, and format conversion is performed in accordance with a format of the image signal (data). The 2D/3D image signal conversion circuit 907 converts the image signal which is subjected to format conversion in the format conversion circuit 906 to an image signal for displaying a planar view or an image signal for displaying a stereoscopic image, based on an image signal conversion memory 910 provided inside the 2D/3D image signal conversion circuit 907. The image signal converted in the 2D/3D image signal conversion circuit 907 is stored in the frame memory 909 through the memory control circuit 908. The image signal stored in the frame memory 909 is read out by the display control circuit 904 through the memory control circuit 908. Then, the display control circuit 904 outputs a signal for the panel control circuit 905 to control the display panel 902.

Further, in the backlight unit 903, lighting of the light sources is controlled by a backlight unit control circuit 911. The backlight unit control circuit 911 is controlled by the display control circuit 904.

As discussed above, with the structure of the block diagram of this embodiment, the driving method of a liquid crystal display device described in any of Embodiment 1 can be realized.

This embodiment can be implemented in appropriate combination with the structures described in the other embodiments.

Embodiment 5

In this embodiment, the appearance and a cross section of the liquid crystal display device described in Embodiment 4 will be described.

Figures 2, 11A:
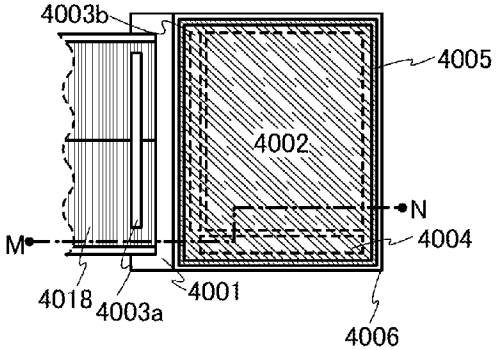
FIGS. 11A-1, 11A-2, and 11B are diagrams to describe the structure of Embodiment 5.
Figures 1, 11A:
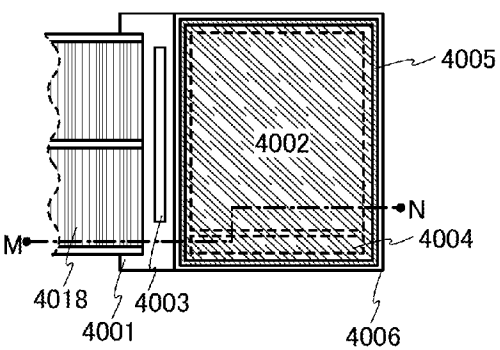
Figure 11B:
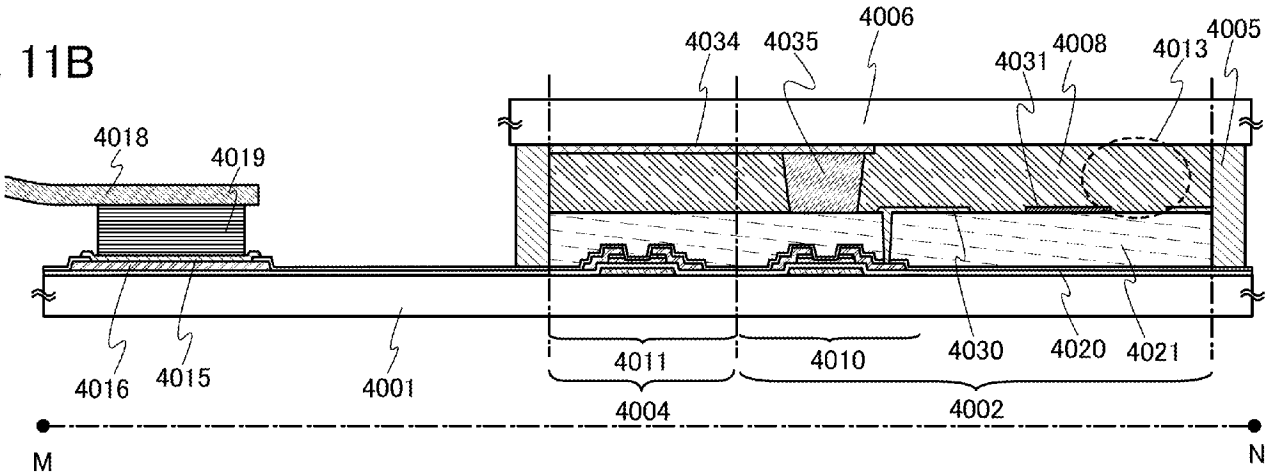

The appearance and a cross section of the liquid crystal display device will be described with reference to FIGS. 11A-1, 11A-2, and 11B. FIGS. 11A-1 and 11A-2 are top views of panels in which transistors 4010 and 4011 and a liquid crystal element 4013 which are formed over a first substrate 4001 are sealed between the first substrate 4001 and a second substrate 4006 with a sealant 4005. FIG. 11B is a cross-sectional view taken along line M-N of FIGS. 11A-1 and 11A-2.

The sealant 4005 is provided so as to surround a pixel portion 4002 and a scan line driver circuit 4004 which are provided over the first substrate 4001. In addition, the second substrate 4006 is provided over the pixel portion 4002 and the scan line driver circuit 4004. Therefore, the pixel portion 4002 and the scan line driver circuit 4004 are sealed together with a liquid crystal layer 4008, by the first substrate 4001, the sealant 4005, and the second substrate 4006.

In FIG. 11A-1, a signal line driver circuit 4003 that is formed using a single crystal semiconductor film or a polycrystalline semiconductor film over a substrate separately prepared is mounted in a region that is different from the region surrounded by the sealant 4005 over the first substrate 4001. In contrast, FIG. 11A-2 illustrates an example in which part of a signal line driver circuit is formed over the first substrate 4001 with the use of a transistor which includes an oxide semiconductor. A signal line driver circuit 4003*b* is formed over the first substrate 4001 and a signal line driver circuit 4003*a* which is formed using a single crystal semiconductor film or a polycrystalline semiconductor film is mounted on the substrate separately prepared.

Note that there is no particular limitation on the connection method of a driver circuit which is separately formed, and a COG method, a wire bonding method, a TAB method, or the like can be used. FIG. 11A-1 illustrates an example of mounting the signal line driver circuit 4003 by a COG method, and FIG. 11A-2 illustrates an example of mounting the signal line driver circuit 4003 by a TAB method.

The pixel portion 4002 and the scan line driver circuit 4004 provided over the first substrate 4001 include a plurality of transistors. FIG. 11B illustrates the transistor 4010 included in the pixel portion 4002 and the transistor 4011 included in the scan line driver circuit 4004, as an example. An insulating layer 4020 and an insulating layer 4021 are provided over the transistors 4010 and 4011.

Various kinds of transistors can be applied to the transistors 4010 and 4011 without particular limitation. A semiconductor formed using silicon (for example, amorphous silicon, microcrystalline silicon, or polysilicon) or an oxide semiconductor can be used for a channel layer of each of the transistors 4010 and 4011.

A pixel electrode layer 4030 and a common electrode layer 4031 are provided over the first substrate 4001, and the pixel electrode layer 4030 is connected to the transistor 4010. The liquid crystal element 4013 includes the pixel electrode layer 4030, the common electrode layer 4031, and the liquid crystal layer 4008.

In a liquid crystal display device including the liquid crystal layer 4008 which exhibits a blue phase, a method in which the gray scale is controlled by generating an electric field generally parallel (i.e., in a lateral direction) to a substrate to move liquid crystal molecules in a plane parallel to the substrate can be used. For such a method, an electrode structure used in an in plane switching (IPS) mode is employed in this embodiment. Note that without limitation to an IPS mode, an electrode structure used in a fringe field switching (FFS) mode can also be employed. In addition, a structure of bend alignment liquid crystals which are controlled by a transverse electric field (also referred to as transverse bend alignment (TBA)) may be used for the liquid crystal layer 4008.

As the first substrate 4001 and the second substrate 4006, glass, plastic, or the like having a light-transmitting property can be used. As plastic, poly(ether sulfone) (PES), polyimide, a fiberglass-reinforced plastic (FRP) plate, a polyvinyl fluoride (PVF) film, a polyester film, or an acrylic resin film can be used. In addition, a sheet with a structure in which an aluminum foil is sandwiched between PVF films or polyester films can be used.

Furthermore, a columnar spacer 4035 which is provided in order to control the thickness (a cell gap) of the liquid crystal layer 4008 can be obtained by selective etching of an insulating film. Note that a spherical spacer may be used instead of the columnar spacer 4035.

In FIGS. 11A-1 and 11A-2 and FIG. 11B, a light-blocking layer 4034 is provided on the second substrate 4006 side so as to cover the transistors 4010 and 4011. With provision of the light-blocking layer 4034, the advantageous effect of stabilizing characteristics of the transistors can be increased. The light-blocking layer 4034 may be provided over the first substrate 4001. In this case, when polymer stabilization is performed by irradiation with ultraviolet rays from the second substrate 4006 side, a liquid crystal over the light-blocking layer 4034 can also be polymer-stabilized when it exhibits a blue phase.

The transistors 4010 and 4011 can be, but is not necessarily, covered with the insulating layer 4020 which functions as a protective film of the transistors 4010 and 4011.

Note that the protective film is provided to prevent entry of contaminant impurities such as organic substance, metal, or moisture existing in air and is preferably a dense film. The protective film may be formed with a single layer or a stacked layer of a silicon oxide film, a silicon nitride film, a silicon oxynitride film, a silicon nitride oxide film, an aluminum oxide film, an aluminum nitride film, an aluminum oxynitride film, and/or an aluminum nitride oxide film by a sputtering method.

After the protective film is formed, the semiconductor layer may be subjected to heat treatment (300° C. to 400° C.).

The pixel electrode layer 4030 and the common electrode layer 4031 can be made of a light-transmitting conductive material such as indium oxide containing tungsten oxide, indium zinc oxide containing tungsten oxide, indium oxide containing titanium oxide, indium tin oxide containing titanium oxide, indium tin oxide (ITO), indium zinc oxide, or indium tin oxide to which silicon oxide is added.

A conductive composition containing a conductive high molecule (also referred to as a conductive polymer) can be used for the pixel electrode layer 4030 and the common electrode layer 4031.

Further, a variety of signals and a potential are supplied to the signal line driver circuit 4003 which is formed separately, the scan line driver circuit 4004, and the pixel portion 4002 from an FPC 4018.

Further, since the transistor is easily broken by static electricity and the like, a protection circuit for protecting the driver circuits is preferably provided over the same substrate for a gate line or a source line. The protection circuit is preferably formed with a non-linear element including an oxide semiconductor.

In FIGS. 11A-1, 11A-2, and 11B, a connection terminal electrode 4015 is formed using the same conductive film as that of the pixel electrode layer 4030, and a terminal electrode 4016 is formed using the same conductive film as that of source and drain electrode layers of the transistors 4010 and 4011.

The connection terminal electrode 4015 is connected to a terminal included in the FPC 4018 via an anisotropic conductive film 4019.

Note that FIGS. 11A-1, 11A-2, and 11B illustrate an example in which the signal line driver circuit 4003 is formed separately and mounted on the first substrate 4001; however, this embodiment is not limited to this structure. The scan line driver circuit may be formed separately and then mounted, or only part of the signal line driver circuit or part of the scan line driver circuit may be formed separately and then mounted.

Figure 12:
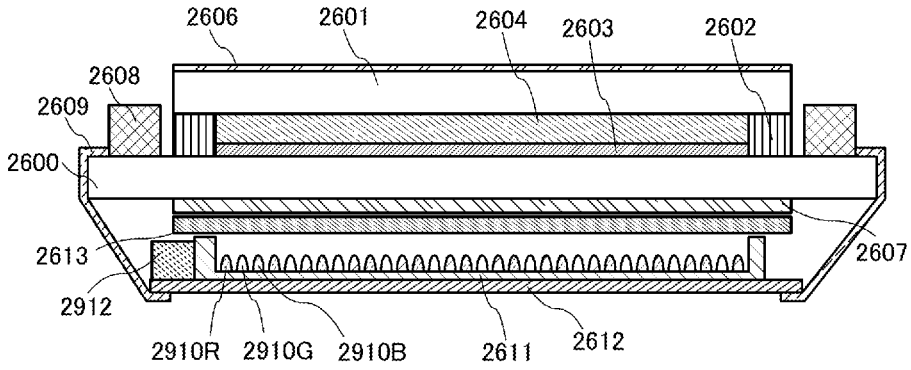
FIG. 12 is a diagram to describe the structure of Embodiment 5.

FIG. 12 illustrates an example of a cross-sectional structure of a liquid crystal display device in which an element substrate 2600 and a counter substrate 2601 are attached to each other with a sealant 2602, and an element layer 2603 including a transistor or the like and a liquid crystal layer 2604 are provided between the substrates.

In order to perform color scan backlight driving described in the above embodiment, light-emitting diodes emitting lights of a plurality of colors are provided as light sources of a backlight unit. For realizing the lights of a plurality of colors, a red light-emitting diode 2910R, a green light-emitting diode 2910G, and a blue light-emitting diode 2910B are used.

A polarizing plate 2606 is provided on the outer side of the counter substrate 2601, and a polarizing plate 2607 and a diffusion sheet 2613 are provided on the outer side of the element substrate 2600. A light source is formed using the red light-emitting diode 2910R, the green light-emitting diode 2910G, the blue light-emitting diode 2910B, and a reflective plate 2611. A backlight drive control circuit 2912 provided for a circuit substrate 2612 is connected to a wiring circuit portion 2608 of the element substrate 2600 via a flexible wiring board 2609 and further includes an external circuit such as a control circuit or a power source circuit.

The light source of the backlight unit can be controlled by the backlight drive control circuit 2912 so as to emit lights of different colors per region.

This embodiment can be implemented in appropriate combination with the structures described in the other embodiments.

Embodiment 6

In this embodiment, structures of a top view and a cross-sectional view corresponding to the circuit diagram of the pixel of the liquid crystal display device illustrated in FIG. 5B of Embodiment 3 will be described.

Figure 13A:
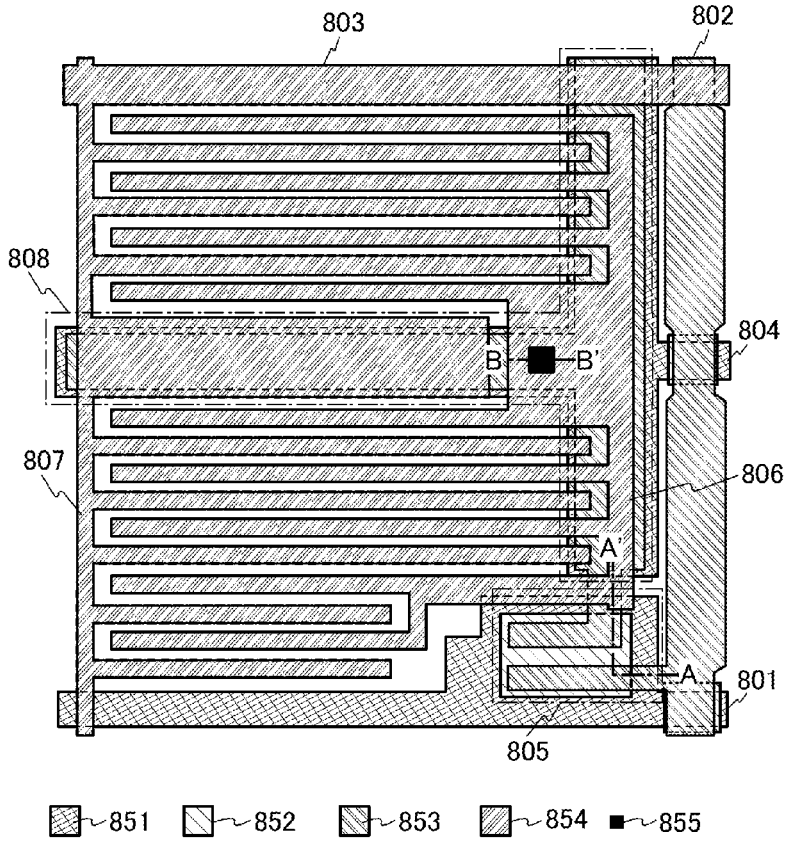
FIGS. 13A and 13B are diagrams to describe the structure of Embodiment 6.
Figure 13B:
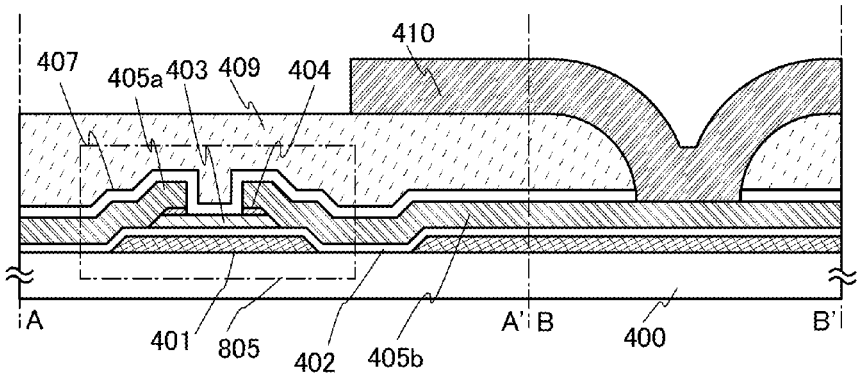

FIGS. 13A and 13B are a top view and a cross-sectional view, respectively, in the case where inverted staggered transistors are used as the transistor of FIG. 5B described in Embodiment 3. The cross-sectional view of the pixel illustrated in FIG. 13B corresponds to lines A-A' and B-B' in the top view of the pixel illustrated in FIG. 13A.

First, an example of the layout of the pixel in the liquid crystal display device is described with reference to FIG. 13A. Note that FIGS. 13A and 13B illustrate a structure applied to the pixel in FIG. 5B described in Embodiment 3.

A pixel illustrated FIG. 13A which can be applied to the liquid crystal display device of Embodiment 3 in FIG. 5B includes a scan line 801, a signal line 802, a common potential line 803, a capacitor line 804, a transistor 805, a pixel electrode 806, a common electrode 807, and a capacitor 808. The structure includes a first conductive layer 851, a semiconductor layer 852, a second conductive layer 853, a third conductive layer 854 (also referred to as a transparent electrode layer), and a contact hole 855.

The first conductive layer 851 has regions functioning as a gate electrode, a scan line 801, and one of electrodes of the capacitor 808. The semiconductor layer 852 has a region functioning as a semiconductor layer of the transistor 805. The second conductive layer 853 has a region functioning as a source and a drain of the transistor, or the signal line 802. The second conductive layer 853 has a region functioning as the other electrode of the capacitor 808. The third conductive layer 854 has regions functioning as a pixel electrode 806 of a liquid crystal element, and the common electrode 807 or the common potential line 803. The contact hole 855 has a function of connecting between the second conductive layer 853 and the third conductive layer 854.

Figure 14:
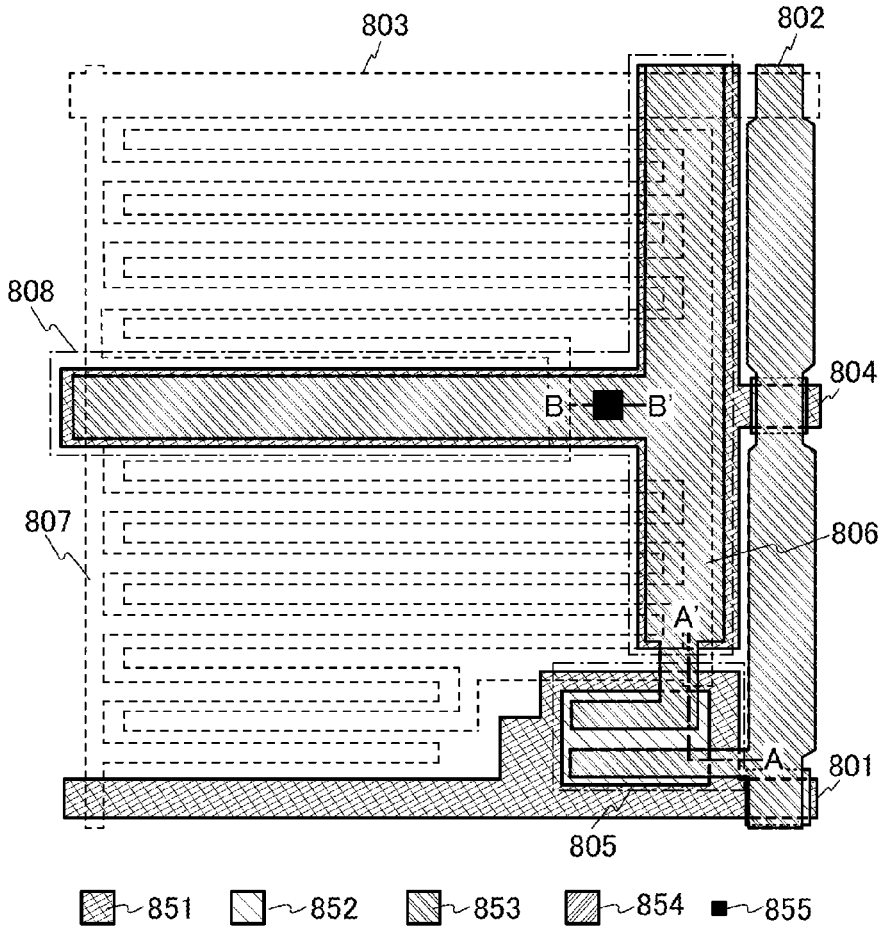
FIG. 14 is a diagram to describe the structure of Embodiment 6.

Note that FIG. 14 illustrates a layout of a pixel in which the third conductive layer 854 is not illustrated. As illustrated in FIG. 14, the capacitor 808 is formed in such a way that part of the third conductive layer 854, the first conductive layer 851, and the second conductive layer 853 are overlapped with each other.

In the layout of the pixel illustrated in each of FIG. 13A and FIG. 14, the pixel electrode 806 and the common electrode 807 are provided in a comb shape and fit into each other at intervals. With the structure, a transverse electric field can be generated between the pixel electrode 806 and the common electrode 807, so that a liquid crystal material showing a blue phase or the like can be controlled.

Next, the structure of the cross-sectional view illustrated in FIG. 13B will be described. There is no particular limitation on a structure of the transistor that can be applied to the liquid crystal display device disclosed in this specification. For example, a staggered transistor, a planar transistor, or the like having a top-gate structure in which a gate electrode is placed on an upper side of a semiconductor layer with a gate insulating layer interposed or a bottom-gate structure in which a gate electrode is placed on a lower side of a semiconductor layer with a gate insulating layer interposed, can be used. The transistor may have a single-gate structure in which one channel formation region is formed, a double-gate structure in which two channel formation regions are formed, or a triple-gate structure in which three channel formation regions are formed. Alternatively, the transistor may have a dual gate structure including two gate electrode layers placed over and below a channel region with a gate insulating layer interposed therebetween.

The transistor 805 in FIG. 13B is an inverted staggered transistor.

The transistor 805 includes, over a substrate 400 having an insulating surface, a gate electrode layer 401, a gate insulating layer 402, a semiconductor layer 403, an n-type semiconductor layer 404, a source electrode layer 405*a*, and a drain electrode layer 405*b*. An insulating layer 407 covering the transistor 805 is stacked over the semiconductor layer 403. An insulating layer 409 is provided over the insulating layer 407.

Although there is no particular limitation on a substrate that can be used as the substrate 400 having an insulating surface, a glass substrate made of barium borosilicate glass, aluminoborosilicate glass, or the like can be used.

In the bottom-gate transistor 805, an insulating layer serving as a base film may be provided between the substrate and the gate electrode layer. The base film has a function of preventing diffusion of an impurity element from the substrate, and can be formed to have a single-layer structure or a layered structure including any of a silicon nitride layer, a silicon oxide layer, a silicon nitride oxide layer, and a silicon oxynitride layer.

The gate electrode layer 401 can be formed to have a single-layer or layered structure using a metal material such as molybdenum, titanium, chromium, tantalum, tungsten, aluminum, copper, neodymium, or scandium, or an alloy material which contains any of these materials as its main component.

The gate insulating layer 402 can be formed with a single-layer structure or a layered structure using any of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer by a plasma enhanced CVD method, a sputtering method, or the like.

As a semiconductor material of the semiconductor layer 403, amorphous silicon, microcrystalline silicon, polysilicon, an oxide semiconductor, an organic semiconductor, or the like can be used. As the n-type semiconductor layer 404, the semiconductor layer 403 to which an n-type impurity element is introduced may be used, for example.

For a conductive film used for the source electrode layer 405*a* and the drain electrode layer 405*b*, for example, an element selected from Al, Cr, Cu, Ta, Ti, Mo, and W, an alloy containing any of these elements as a component, an alloy film in which any of these elements are combined, or the like can be used. The conductive film may have a structure in which a high-melting-point metal layer of Ti, Mo, W, or the like is stacked over and/or below a metal layer of Al, Cu, or the like. When an Al material to which an element (e.g., Si, Nd, or Sc) which prevents generation of hillocks and whiskers in an Al film is added is used, heat resistance can be increased.

Alternatively, the conductive film to be the source electrode layer 405*a* and the drain electrode layer 405*b* (including a wiring layer formed using the same layer as the source and drain electrode layers) may be formed using a conductive metal oxide. As a conductive metal oxide, indium oxide ($In_2O_3$), tin oxide ($SnO_2$), zinc oxide (ZnO), indium oxide-tin oxide alloy ($In_2O_3$—$SnO_2$; abbreviated to ITO), indium oxide-zinc oxide alloy ($In_2O_3$—ZnO), or any of these metal oxide materials in which silicon oxide is contained can be used.

As the insulating layer 407, typically, an inorganic insulating film such as a silicon oxide film, a silicon oxynitride film, an aluminum oxide film, or an aluminum oxynitride film can be used.

A planarization insulating film for suppressing surface unevenness due to the transistor is preferable as the insulating layer 409. An organic material such as polyimide, acrylic, or benzocyclobutene can be used for the insulating layer 409. Other than such organic materials, it is also possible to use a low-dielectric constant material (a low-k material) or the like. Note that the planarization insulating film may be formed by stacking a plurality of insulating films formed from these materials.

Note that the insulating layer 407 and the insulating layer 409 have a contact hole, and a pixel electrode 410 and the drain electrode layer 405*b* are in direct contact with each other through the contact hole. In addition, over the insulating layer 409, a common electrode and a common potential line (not illustrated) are provided in addition to the pixel electrode 410. A conductive film used for the pixel electrode 410 and the common electrode can be formed using an element selected from Al, Cr, Cu, Ta, Ti, Mo, and W, an alloy including any of these elements as a main component, an alloy film including a combination of any of these elements, or the like. The conductive film may have a structure in which a high-melting-point metal layer of Ti, Mo, W, or the like is stacked over and/or below a metal layer of Al, Cu, or the like. When an A1 material to which an element (e.g., Si, Nd, or Sc) which prevents generation of hillocks and whiskers in an Al film is added is used, heat resistance can be increased.

Alternatively, the conductive film to be the pixel electrode 410 and the common electrode may be formed using a conductive metal oxide. As a conductive metal oxide, indium oxide ($In_2O_3$), tin oxide ($SnO_2$), zinc oxide (ZnO), indium oxide-tin oxide ($In_2O_3$—$SnO_2$; abbreviated to ITO), indium oxide-zinc oxide ($In_2O_3$—ZnO), or any of these metal oxide materials in which silicon oxide is contained can be used.

Figure 15A:
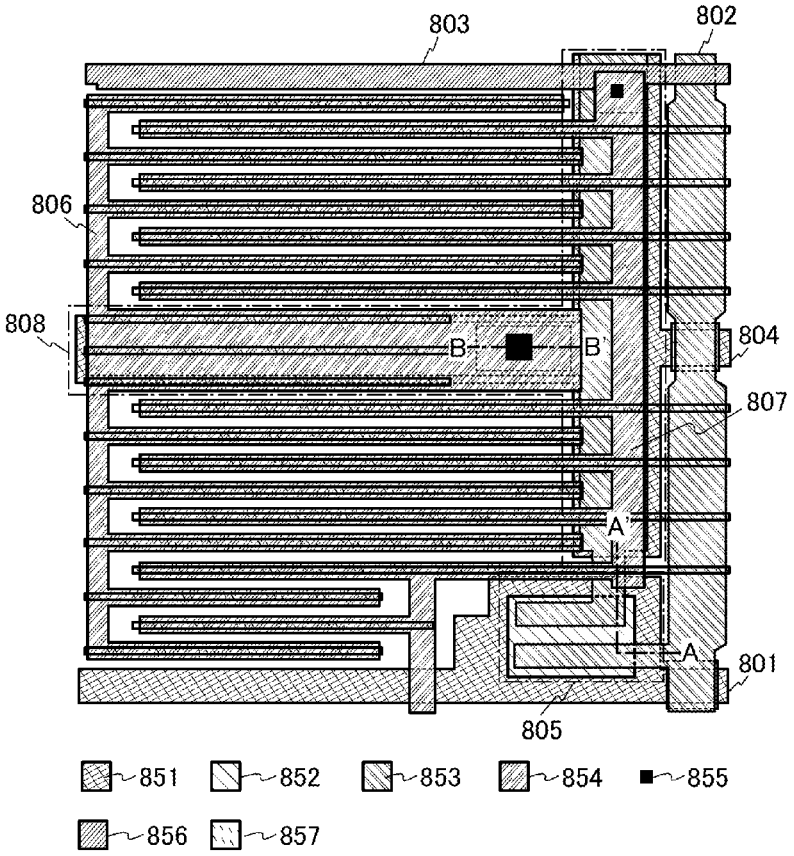
FIGS. 15A and 15B are diagrams to describe the structure of Embodiment 6.
Figure 15B:
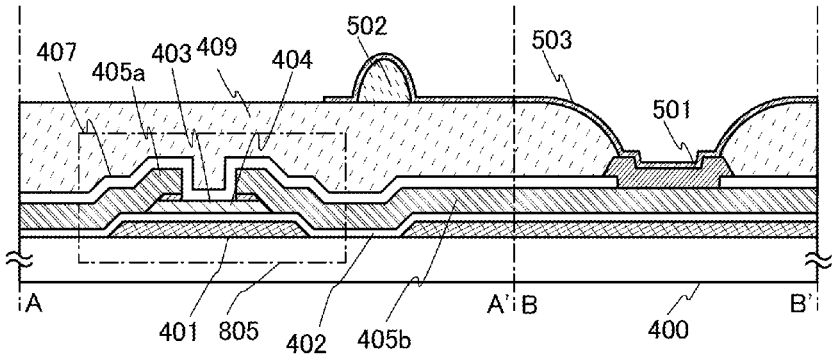

Note that it is preferable that a conductive film serving as the pixel electrode 410 and the common electrode have a large thickness so that a transverse electric field generated by the pixel electrode 410 and the common electrode can be easily applied to liquid crystals. In that case, when a material which does not have a light-transmitting property is used for the pixel electrode 410 and the common electrode, there is a concern about a significant decrease of an aperture ratio of the pixel; therefore, it is preferable that a rib-shaped transparent structure body be provided below the pixel electrode 410 and the common electrode. FIGS. 15A and 15B illustrate a structure in which a rib-shaped transparent structure body is provided.

FIGS. 15A and 15B are a top view and a cross-sectional view different from FIGS. 13A and 13B. The cross-sectional view of the pixel illustrated in FIG. 15B corresponds to lines A-A' and B-B' in the top view of the pixel illustrated in FIG. 15A.

First, an example of a layout of a pixel of a liquid crystal display device which is different from that in FIG. 13A will be described with reference to FIG. 15A.

The pixel illustrated in FIG. 15A includes the scan line 801, the signal line 802, the common potential line 803, the capacitor line 804, the transistor 805, the pixel electrode 806, the common electrode 807, and the capacitor 808. The structure includes the first conductive layer 851, the semiconductor layer 852, the second conductive layer 853, the third conductive layer 854 (also referred to as a transparent electrode layer), the contact hole 855, a fourth conductive layer 856, and a transparent insulating layer 857.

The first conductive layer 851 has regions functioning as a gate electrode, a scan line 801, and one of the electrodes of the capacitor 808. The semiconductor layer 852 has regions that function as semiconductor layers of the transistor 805. The second conductive layer 853 has regions that function as sources and drains of the transistor, the signal line 802, and the other of the electrodes of the capacitor 808. The third conductive layer 854 has a region that functions as the pixel electrode 806 of a liquid crystal element and a region that functions as the common electrode 807. The contact hole 855 has a function of connecting the second conductive layer 853 and the third conductive layer 854 through the fourth conductive layer 856. The fourth conductive layer 856 has a region functioning as the common potential line 803. The transparent insulating layer 857 is provided to overlap with the pixel electrode 806 and the common electrode 807 with a comb shape, in the lower portion.

Figure 16:
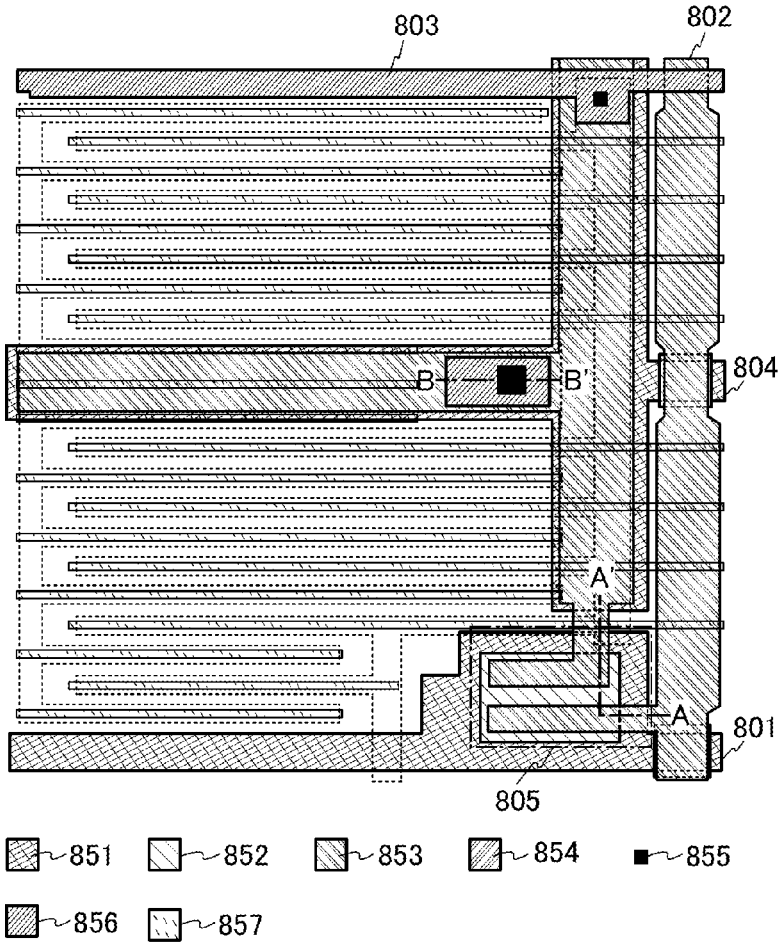
FIG. 16 is a diagram to describe the structure of Embodiment 6.

Note that FIG. 16 illustrates a layout of a pixel from which the third conductive layer 854 is not illustrated. As illustrated in FIG. 16, the first conductive layer 851 and the second conductive layer 853 overlap with each other, overlapping with part of the third conductive layer 854, to form the capacitor 808. Further, the transparent insulating layer 857 extends from a region overlapping with the pixel electrode 806 and the common electrode 807 to a region overlapping with the signal line 802.

In the layout of the pixel illustrated in each of FIG. 15A and FIG. 16, the pixel electrode 806 and the common electrode 807 are formed in a comb shape and fit into each other at intervals. With the structure, a transverse electric field can be generated between the pixel electrode 806 and the common electrode 807, so that a liquid crystal material showing a blue phase or the like can be controlled. In particular, in the layout of the pixel illustrated in each of FIG. 15A and FIG. 16, the pixel electrode 806 and the common electrode 807 are increased in volume by the transparent insulating layer 857 and provided, so that the horizontal electric field can be applied to the liquid crystal element easily. Further, when each of the pixel electrode 806 and the common electrode 807 are a transparent conductive layer, an aperture ratio can be increased.

Next the structure of the cross-sectional view illustrated in FIG. 15B is described similarly to FIG. 13B. The transistor 805 in FIG. 15B illustrated as an example is an inverted staggered transistor. Here, only the structure of the cross-sectional view illustrated in FIG. 15B different from that in FIG. 13B is described.

Unlike the case of FIG. 13B, the insulating layer 407 in FIG. 15B is provided with a contact hole before formation of the insulating layer 409. In the contact hole, an electrode of a fourth conductive layer 501 is provided. Note that a common potential line is formed in the same layer as the electrode of the fourth conductive layer 501. Next, the insulating layer 409 is provided over the insulating layer 407 except over the fourth conductive layer 501.

Note that a rib-shaped transparent body 502 which is formed using a transparent insulating layer is formed over the insulating layer 409. Further, a pixel electrode 503 of the third conductive layer and a common electrode (not shown) are formed to connect the top surfaces of the transparent bodies 502 and a space between the plurality of transparent bodies 502 with a comb shape.

Note that as a material forming a transparent body, a material with light transmittance can be used and the material may be an insulator or a conductive material. Specifically, an acrylic resin, an epoxy resin, an amine resin, or the like may be used. The transparent body preferably has a shape which is covered well such as a trapezoid shape or a bell shape (a dome shape).

Note that an example of a conductive film used for the pixel electrode 503 and the common electrode is formed of metal oxide with transmittance and conductivity. As the electrically conductive metal oxide, indium oxide ($In_2O_3$), tin oxide ($SnO_2$), zinc oxide (ZnO), indium oxide-tin oxide ($In_2O_3$—$SnO_2$; abbreviated to ITO), indium oxide-zinc oxide ($In_2O_3$—ZnO), or any of these metal oxide materials in which silicon or silicon oxide is contained can be used.

This embodiment can be combined with any of the other embodiments as appropriate.

Embodiment 7

A display device disclosed in this specification can be applied to a variety of electronic devices (including game machines). Examples of electronic devices are a television set (also referred to as a television or a television receiver), a monitor of a computer or the like, a camera such as a digital camera or a digital video camera, a digital photo frame, a mobile phone handset (also referred to as a mobile phone or a mobile phone device), a portable game machine, a portable information terminal, an audio reproducing device, a large-sized game machine such as a pachinko machine, and the like. Examples of electronic devices each including the display device described in any of the above embodiments will be described.

Figure 17A:
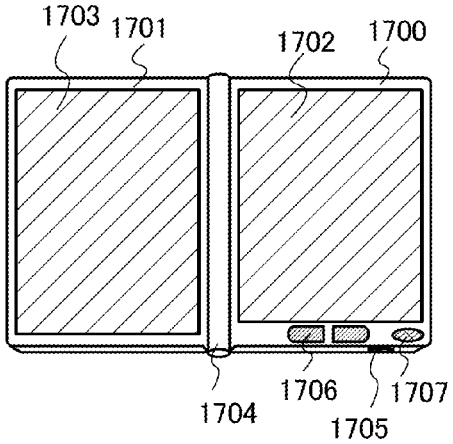
FIGS. 17A to 17D are diagrams to describe the structure of Embodiment 7.

FIG. 17A illustrates an example of the electronic book readers. The electronic book reader illustrated in FIG. 17A includes two housings, a housing 1700 and a housing 1701. The housing 1700 and the housing 1701 are combined with a hinge 1704 so that the electronic book reader can be opened and closed. With such a structure, the electronic book reader can be operated like a paper book.

A display portion 1702 and a display portion 1703 are incorporated in the housing 1700 and the housing 1701, respectively. The display portion 1702 and the display portion 1703 may be configured to display one image or different images. In the case where the display portion 1702 and the display portion 1703 display different images, for example, a display portion on the right side (the display portion 1702 in FIG. 17A) can display text and a display portion on the left side (the display portion 1703 in FIG. 17A) can display graphics.

Further, FIG. 17A illustrates an example in which the housing 1700 is provided with an operation portion and the like. For example, the housing 1700 is provided with a power supply input terminal 1705, an operation key 1706, a speaker 1707, and the like. With the operation key 1706, pages can be turned. Note that a keyboard, a pointing device, or the like may be provided on the surface of the housing, on which the display portion is provided. Further, an external connection terminal (an earphone terminal, a USB terminal, a terminal that can be connected to various cables such as a USB cable, or the like), a recording medium insertion portion, or the like may be provided on the back surface or the side surface of the housing. Further, a function of an electronic dictionary may be provided for the electronic book reader illustrated in FIG. 17A.

Figure 17B:
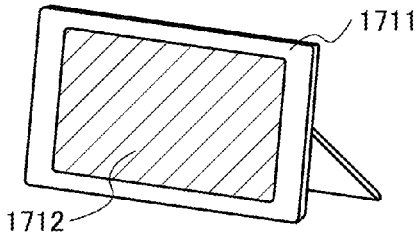

FIG. 17B illustrates an example of a digital photo frame including a display device. For example, in the digital photo frame illustrated in FIG. 17B, a display portion 1712 is incorporated in a housing 1711. The display portion 1712 can display various images. For example, the display portion 1712 can display data of an image taken with a digital camera or the like and function as a normal photo frame.

Note that the digital photo frame illustrated in FIG. 17B may be provided with an operation portion, an external connection terminal (a USB terminal, a terminal that can be connected to various cables such as a USB cable, or the like), a recording medium insertion portion, and the like. Although these components may be provided on the surface on which the display portion is provided, it is preferable to provide them on the side surface or the back surface for the design of the digital photo frame. For example, a memory storing data of an image taken with a digital camera is inserted in the recording medium insertion portion of the digital photo frame, whereby the image data can be transferred and then displayed on the display portion 1712.

Figure 17C:
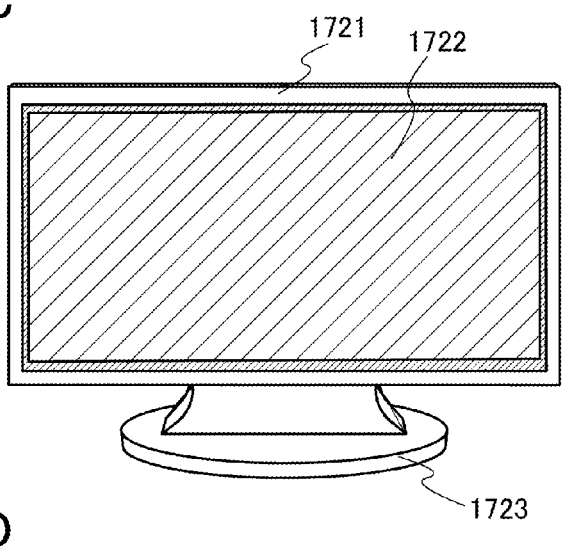

FIG. 17C illustrates an example of a television set including a display device. In the television set illustrated in FIG. 17C, a display portion 1722 is incorporated in a housing 1721. The display portion 1722 can display an image. Further, the housing 1721 is supported by a stand 1723 here. The display device described in any of the above embodiments can be used in the display portion 1722.

The television set illustrated in FIG. 17C can be operated with an operation switch of the housing 1721 or a separate remote controller. Channels and volume can be controlled with an operation key of the remote controller so that an image displayed on the display portion 1722 can be controlled. Further, the remote controller may be provided with a display portion for displaying data output from the remote controller.

Figure 17D:
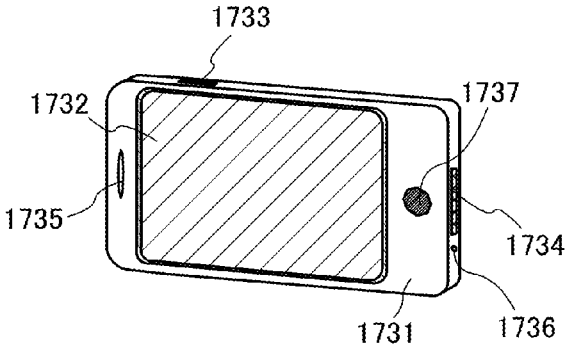
Figure 18A:
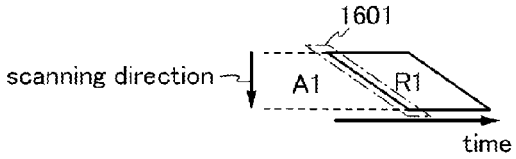
FIG. 18A Prior Art
FIGS. 18A and 18B are diagrams to describe problems.
Figure 18B:
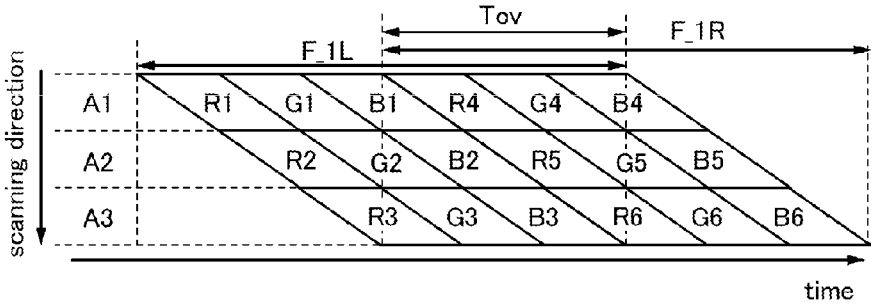
FIG. 18B Prior Art

FIG. 17D illustrates an example of a mobile phone handset including a display device. The mobile phone handset illustrated in FIG. 17D is provided with a display portion 1732 incorporated in a housing 1731, an operation button 1733, an operation button 1737, an external connection port 1734, a speaker 1735, a microphone 1736, and the like.

The display portion 1732 of the mobile phone handset illustrated in FIG. 17D is a touch panel. By touching the display portion 1732 with a finger or the like, contents displayed on the display portion 1732 can be controlled. Further, operations such as making calls and texting can be performed by touching the display portion 1732 with a finger or the like.

This embodiment can be implemented in appropriate combination with the structures described in the other embodiments.

This application is based on Japanese Patent Application serial no. 2010-285253 filed with Japan Patent Office on Dec. 22, 2010, the entire contents of which are hereby incorporated by reference.

What is claimed is:

1. A method for driving a liquid crystal display device comprising:

selecting one of a plurality of scan lines in each of a plurality of divided regions in a display region at the same time, wherein the divided regions comprise a first divided region, a second divided region and a third divided region;

writing a first image signal in the first divided region in a first sub-frame period of a first frame period;

lighting a first light source of a first color in the first divided region in accordance with the first image signal;

writing a second image signal in the first divided region in a first sub-frame period of a second frame period just after lighting the first light source without a period where the first light source is not lit;

lighting a second light source of a second color in the first divided region in accordance with the second image signal;

writing a third image signal in the second divided region in the first sub-frame period of the first frame period;

lighting a third light source of a third color in the second divided region in accordance with the third image signal;

writing a fourth image signal in the second divided region in the first sub-frame period of the second frame period just after lighting the third light source without a period where the third light source is not lit;

lighting a fourth light source of the first color in the second divided region in accordance with the fourth image signal;

writing a fifth image signal in the third divided region in the first sub-frame period of the first frame period;

lighting a fifth light source of a fourth color in the third divided region in accordance with the fifth image signal;

writing a sixth image signal in the third divided region in the first sub-frame period of the second frame period just after lighting the fifth light source without a period where the fifth light source is not lit; and lighting a sixth light source of the third color in the third divided region in accordance with the sixth image signal, wherein the second frame period is after the first frame period.

2. The method for driving a liquid crystal display device according to claim 1, wherein a first image is displayed for one of a right eye and a left eye in the first frame period, and wherein a second image is displayed for the other of the right eye and the left eye in the second frame period.

3. The method for driving a liquid crystal display device according to claim 2, wherein the first image and the second image are displayed alternately on the display region.

4. The method for driving a liquid crystal display device according to claim 1, wherein each period of the lighting step of the first light source and the second light source is shorter than each period of the writing step of the first image signal-and the second image signal.

5. The method for driving a liquid crystal display device according to claim 1, wherein the liquid crystal display device comprises a liquid crystal element, and wherein the liquid crystal element comprises a liquid crystal material exhibiting a blue phase.

6. A method for driving a liquid crystal display device comprising:

selecting one of a plurality of scan lines in each of a plurality of divided regions in a display region at the same time, wherein the divided regions comprise a first divided region;

writing a first image signal in the first divided region in a first sub-frame period of a first frame period;

lighting a first light source of a first color in the first divided region in accordance with the first image signal;

writing a second image signal in the first divided region in a second sub-frame period of the first frame period just after lighting the first light source without a period where the first light source is not lit;

lighting a second light source of a second color in the first divided region in accordance with the second image signal;

writing a third image signal in the first divided region in a third sub-frame period of the first frame period just after lighting the second light source without a period where the second light source is not lit;

lighting a third light source of a third color in the first divided region in accordance with the third image signal;

writing a fourth image signal in the first divided region in a first sub-frame period of a second frame period just after lighting the third light source without a period where the third light source is not lit; and lighting the first light source in the first divided region in accordance with the fourth image signal, wherein the second frame period is after the first frame period, wherein the second sub-frame period of the first frame period is after the first sub-frame period of the first frame period, and wherein the third sub-frame period of the first frame period is after the second sub-frame period of the first frame period.

7. The method for driving a liquid crystal display device according to claim 6, wherein a first image is displayed for one of a right eye and a left eye in the first frame period, and wherein a second image is displayed for the other of the right eye and the left eye in the second frame period.

8. The method for driving a liquid crystal display device according to claim 6, further comprising:

writing a fifth image signal in the first divided region in a second sub-frame period of the second frame period just after lighting the first light source after writing the fourth image signal;

lighting the second light source in the first divided region in accordance with the fifth image signal;

writing a sixth image signal in the first divided region in a third sub-frame period of the second frame period just after lighting the second light source after writing the fifth image signal; and lighting the third light source in the first divided region in accordance with the sixth image signal, wherein the first frame period and the second frame period are provided alternately.

9. The method for driving a liquid crystal display device according to claim 6, wherein the first image signal, the second image signal, and the third image signal are written to each of the plurality of divided regions.

10. The method for driving a liquid crystal display device according to claim 7, wherein the first image and the second image are displayed alternately on the display region.

11. The method for driving a liquid crystal display device according to claim 6, wherein each period of the lighting step of the first light source, the second light source, and the third light source is shorter than each period of the writing step of the first image signal, the second image signal, and the third image signal.

12. The method for driving a liquid crystal display device according to claim 6, wherein the divided regions further comprises a second divided region and a third divided region, wherein, in the first sub-frame period of the first frame period, an image signal for lighting a fourth light source of the third color is written in the second divided region, wherein, in the first sub-frame period of the first frame period, an image signal for lighting a fifth light source of the second color is written in the third divided region, wherein, in the second sub-frame period of the first frame period, an image signal for lighting a sixth light source of the first color is written in the second divided region, wherein, in the second sub-frame period of the first frame period, an image signal for lighting a seventh light source of the third color is written in the third divided region, wherein, in the third sub-frame period of the first frame period, an image signal for lighting an eighth light source of the second color is written in the second divided region, and wherein, in the third sub-frame period of the first frame period, an image signal for lighting a ninth light source of the first color is written in the third divided region.

13. The method for driving a liquid crystal display device according to claim 7, wherein the first image is displayed by lighting of the first light source, the second light source and the third light source in accordance with the first image signal, the second image signal and the third image signal.

14. The method for driving a liquid crystal display device according to claim 6, wherein the liquid crystal display device comprises a liquid crystal element, and wherein the liquid crystal element comprises a liquid crystal material exhibiting a blue phase.

15. The method for driving a liquid crystal display device according to claim 6, wherein the first color is red, wherein the second color is green, and wherein the third color is blue.

16. A method for driving a liquid crystal display device comprising:

selecting one of a plurality of scan lines in each of a plurality of divided regions in a display region at the same time, writing a first image signal in a first sub-frame period of a first frame period for lighting of a first light source, wherein the lighting of the first light source is performed just before writing of a second image signal of a second sub-frame period of the first frame period without a period where the first light source is not lit;

writing the second image signal in the second sub-frame period of the first frame period for lighting of a second light source, wherein the lighting of the second light source is performed just before writing of a third image signal of a third sub-frame period of the first frame period without a period where the second light source is not lit; and writing the third image signal in the third sub-frame period of the first frame period for lighting of a third light source, wherein the lighting of the third light source is performed just before writing of a fourth image signal of a first sub-frame period of a second frame period without a period where the third light source is not lit, wherein the second frame period is after the first frame period, wherein the second sub-frame period of the first frame period is after the first sub-frame period of the first frame period, wherein the third sub-frame period of the first frame period is after the second sub-frame period of the first frame period, wherein colors by lighting of the first light source, the second light source, and the third light source in accordance with the first image signal, the second image signal, and the third image signal are different from each other, wherein a first image for one of a left eye and a right eye is displayed in the first frame period, wherein a second image for the other of the left eye and the right eye is displayed in the second frame period, wherein the first image and the second image are displayed alternately on the display region, and wherein color display in the display region in the first frame period and the second frame period is performed by lighting of the first light source, the second light source, and the third light source in accordance with the first image signal, the second image signal, and the third image signal.

17. The method for driving a liquid crystal display device according to claim 16, wherein the first image and the second image are alternately perceived by glasses, and wherein switching of a perception is performed at timing at which lighting of the third light source in accordance with the third image signal, and lighting of a fourth light source in accordance with the fourth image signal are switched.

18. The method for driving a liquid crystal display device according to claim 16, wherein a period in which the first light source, the second light source, and the third light source are lit in accordance with the first image signal, the second image signal, and the third image signal is shorter than a period of writing of the first image signal, the second image signal, and the third image signal.

19. The method for driving a liquid crystal display device according to claim 16, wherein the liquid crystal display device comprises a liquid crystal element, and wherein the liquid crystal element comprises a liquid crystal material exhibiting a blue phase.

20. The method for driving a liquid crystal display device according to claim 16, wherein the first light source is a light source of red color, wherein the second light source is a light source of green color, and wherein the third light source is a light source of blue color.

* * * * *